US010863819B1

(12) United States Patent
Chen

(10) Patent No.: US 10,863,819 B1
(45) **Date of Patent: *Dec. 15, 2020**

(54) FOLDING/UNFOLDING MECHANISM, FRAME AND TABLE HAVING SAME

(71) Applicant: Inno-Sports Co., Ltd., Xiamen (CN)

(72) Inventor: Renhua Chen, Xiamen (CN)

(73) Assignee: Inno-Sports Co., Ltd., Xiamen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/838,939

(22) Filed: Apr. 2, 2020

(30) Foreign Application Priority Data

Oct. 9, 2019 (CN) ..... 2019 2 1680600 U
Oct. 9, 2019 (CN) ..... 2019 2 1686275 U

(51) Int. Cl.
*A47B 3/083* (2006.01)
*A47B 3/087* (2006.01)
*A47B 13/08* (2006.01)

(52) U.S. Cl.
CPC ..... *A47B 3/087* (2013.01); *A47B 13/088* (2013.01)

(58) Field of Classification Search
CPC ..... A47B 3/083; A47B 3/087; A47B 3/091; A47B 3/0911; A47B 3/0913; A47B 3/0915; A47B 3/0916; A47B 2003/0835; A47B 13/088; Y10T 16/540247
See application file for complete search history.

(56) References Cited

U.S. PATENT DOCUMENTS 2,136,569 A 11/1938 Trimpi
2,803,033 A * 8/1957 Rachman ..... F16C 11/04 16/326
3,075,809 A * 1/1963 Wilson ..... A47B 3/14 297/158.4
3,410,232 A * 11/1968 Bills ..... A47B 3/0912 108/146
6,508,262 B1 1/2003 Takayama
6,843,183 B2 1/2005 Strong
7,059,254 B2 6/2006 Strong et al.
(Continued)

FOREIGN PATENT DOCUMENTS

EP 1492432 B1 10/2016
WO WO 2013000149 A1 1/2013

OTHER PUBLICATIONS

U.S. Appl. No. 29/728,684, filed Mar. 20, 2020.
(Continued)

*Primary Examiner* — Matthew W Ing
(74) *Attorney, Agent, or Firm* — Morgan, Lewis & Bockius LLP

(57) ABSTRACT

A folding/unfolding mechanism includes first, second and third coupling pieces. Each of the first and second coupling pieces is configured to be fixed at an end of a bar and includes a hole and a slot with a closed bottom and an open top. The third coupling piece includes a slot with closed bottom and top. A first rod passes through the holes of the first and second coupling pieces and the slot of the third coupling piece. A second rod is integrally formed or coupled with a top portion of the third coupling piece, and movable together with the third coupling piece. The second rod is selectively inserted into the slots of the first and second coupling pieces, thereby selectively restricting the rotation of the first and second coupling pieces with respect to each other.

18 Claims, 19 Drawing Sheets

(56) References Cited

U.S. PATENT DOCUMENTS

| | | | | |
|---|---|---|---|---|
| 7,096,799 | B2 | 8/2006 | Strong et al. | |
| 7,097,380 | B2 | 8/2006 | Lee | |
| 7,171,910 | B2 | 2/2007 | Neunzert et al. | |
| 7,428,872 | B2 | 9/2008 | Strong et al. | |
| 7,475,643 | B2 | 1/2009 | Haney et al. | |
| 7,475,644 | B2 | 1/2009 | Strong et al. | |
| 7,634,969 | B2 | 12/2009 | Neunzert et al. | |
| 7,640,870 | B2 | 1/2010 | Strong et al. | |
| 7,644,667 | B2 | 1/2010 | Strong et al. | |
| 7,735,431 | B2 | 6/2010 | Neunzert et al. | |
| 7,874,303 | B2 | 1/2011 | Xie | |
| 8,006,630 | B2 | 8/2011 | Strong et al. | |
| 8,033,228 | B2 | 10/2011 | Haney et al. | |
| 8,042,475 | B2 | 10/2011 | Larcom et al. | |
| 8,156,875 | B2 | 4/2012 | Neunzert et al. | |
| 8,302,541 | B2 | 11/2012 | Haney et al. | |
| 8,342,107 | B2 | 1/2013 | Mover et al. | |
| 8,534,205 | B1 | 9/2013 | Johnson et al. | |
| 8,578,865 | B2 | 11/2013 | Haney et al. | |
| 8,622,007 | B2 | 1/2014 | Peery et al. | |
| 8,746,155 | B2 | 6/2014 | Haney et al. | |
| 8,757,069 | B2 | 6/2014 | Peery et al. | |
| 9,027,952 | B2 | 5/2015 | Zhu | |
| D748,418 | S | 2/2016 | Johnson et al. | |
| 9,277,808 | B2 | 3/2016 | Cai et al. | |
| D756,694 | S | 5/2016 | Johnson et al. | |
| 9,351,563 | B2 | 5/2016 | Bennett et al. | |
| 10,470,561 | B2 | 11/2019 | Clegg et al. | |
| 2003/0089286 | A1 | 5/2003 | Wang | |
| 2008/0078310 | A1* | 4/2008 | VanNimwegen | A47B 3/0916 108/127 |
| 2013/0000528 | A1* | 1/2013 | Jin | A47B 3/0915 108/127 |
| 2013/0233210 | A1* | 9/2013 | Jin | A47B 3/0818 108/166 |
| 2014/0030012 | A1 | 1/2014 | Lee | |
| 2014/0099155 | A1 | 4/2014 | Chen | |
| 2014/0130837 | A1 | 5/2014 | Sy-Facunda | |
| 2016/0348395 | A1 | 12/2016 | Jin | |
| 2017/0013955 | A1* | 1/2017 | Lin | A47C 11/00 |
| 2018/0153302 | A1* | 6/2018 | Jiang | A47B 95/00 |
| 2019/0150608 | A1 | 5/2019 | Johnson et al. | |
| 2019/0284831 | A1 | 9/2019 | Volin | |
| 2019/0292808 | A1 | 9/2019 | Dotterweich | |

OTHER PUBLICATIONS

U.S. Appl. No. 29/728,685, filed Mar. 20, 2020.
U.S. Appl. No. 16/838,944, filed Apr. 2, 2020.
U.S. Appl. No. 16/838,947, filed Apr. 2, 2020.
U.S. Appl. No. 16/839,337, filed Apr. 3, 2020.

* cited by examiner

FOLDING/UNFOLDING MECHANISM, FRAME AND TABLE HAVING SAME

CROSS-REFERENCE TO RELATED APPLICATIONS

The present application claims priority to Chinese Utility Model Applications CN 201921680600.1 filed Oct. 9, 2019 and CN 201921686275.X filed Oct. 9, 2019. The disclosure of each application is incorporated herein for all purposes by reference in its entirety.

FIELD OF THE INVENTION

The present invention generally relates to control mechanisms, frames and tables, and in particular to locking/unlocking mechanisms, folding/unfolding mechanisms, sliders, and frames and tables having one or more of the locking/unlocking mechanisms, folding/unfolding mechanisms and sliders.

BACKGROUND

Most of existing tables are not foldable. Some of existing tables are foldable but require assembling by end users. Of existing tables, tabletops and supporting legs are usually packaged separately. They are inconvenient for transportation and storage. Moreover, they require assembling of the tabletops and the legs by end users, which are usually time consuming and sometimes difficult and unmanageable.

Given the current state of the art, there remains a need for control mechanisms, frames and tables that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present disclosure provides control mechanisms such as locking/unlocking mechanisms, folding/unfolding mechanisms, and sliders. The present disclosure further provides frames and tables having one or more of the locking/unlocking mechanisms, folding/unfolding mechanisms and sliders.

In various exemplary embodiments, the present disclosure provides a folding/unfolding mechanism including a first coupling piece, a second coupling piece, a third coupling piece, a first rod and a second rod. The first coupling piece is configured to be fixed at a proximal end of a first bar. The first coupling piece includes a first hole and a first slot above the first hole. The first slot has a closed bottom and an open top. The second coupling piece is configured to be fixed at a proximal end of a second bar. The second coupling piece includes a second hole and a second slot above the second hole. The second slot has a closed bottom and an open top. The third coupling piece includes a third slot and the third slot has a closed bottom and a closed top. The first rod passes through the first hole of the first coupling piece, the second hole of the second coupling piece, and the third slot of the third coupling piece. The first and second coupling pieces are rotatable with respect to each other around the first rod, and the third coupling piece is movable with respect to the first rod between a first position where the first rod is at the bottom of the third slot of the third coupling piece and a second position where the first rod is at the top of the third slot of the third coupling piece. The second rod is integrally formed or coupled with a top portion of the third coupling piece, and movable together with the third coupling piece. When the second rod is disposed in both of the first slot of the first coupling piece and the second slot of the second coupling piece, the first and second coupling pieces are restricted from rotating with respect to each other. When the second rod is released from any one of the first slot of the first coupling piece and the second slot of the second coupling piece, the first and second coupling pieces are rotatable with respect to each other.

In an exemplary embodiment, the first slot of the first coupling piece includes a first curved edge at the open top of the first slot to facilitate entry of the first rod into the first slot and exit of the first rod from the first slot, and the open top of the second slot of the second coupling piece includes a second curved edge at the open top of the second slot to facilitate entry of the first rod into the second slot and exit of the first rod from the second slot.

In some exemplary embodiments, each of the first and second coupling pieces includes a horizontal piece, a first lug at a first side of the horizontal piece and a second lug at a second side of the horizontal piece. The first and second lugs are substantially parallel to each other. Each of the first and second lugs is formed with a corresponding first or second hole and a corresponding first or second slot.

In an exemplary embodiment, at least a portion of the third coupling piece is disposed between the first and second lugs of the first coupling piece, and at least a portion of the first and second lugs of the first coupling piece is disposed between the first and second lugs of the second coupling piece.

In an exemplary embodiment, the third coupling piece includes a third hole, wherein the second rod is coupled with the third coupling piece by passing through the third hole of the third coupling piece.

In some exemplary embodiments, the third coupling piece is formed with a cavity. The folding/unfolding mechanism further includes an elastic member and a cover. The elastic member is disposed in the cavity of the third coupling piece. The cover is coupled with the third coupling piece to encase the elastic member in the cavity of the third coupling piece. The elastic member has one end abutting the first rod and another end abutting the cover, thereby positioning the third coupling piece at the second position where the first rod is at the top of the third slot of the third coupling piece.

In an exemplary embodiment, an external force is required to move the third coupling piece from the second position, where the first rod is at the top of the third slot of the third coupling piece, toward the first position, where the first rod is at the bottom of the third slot of the third coupling piece.

In various exemplary embodiments, the present disclosure provides a frame including a first longitudinal bar disposed at a first side of the frame, and a second longitudinal bar disposed at a second side of the frame and substantially parallel to the first longitudinal bar. Each of the first and second longitudinal bars includes a first bar and a second bar pivotally connected with each other. For at least one of the first and second longitudinal bars, the first and second bars are pivotally connected with each other by a folding/unfolding mechanism disclosed herein. The folding/unfolding mechanism includes a first coupling piece, a second coupling piece, a third coupling piece, a first rod and a second rod. The first coupling piece is fixed at a proximal end of the first bar. The first coupling piece includes a first hole and a first slot above the first hole. The first slot has a closed bottom and an open top. The second coupling piece is fixed at a proximal end of the second bar. The second coupling piece includes a second hole and a second slot above the second hole. The second slot has a closed bottom and an open top. The third coupling piece includes a third slot and the third slot has a closed bottom and a closed top. The first rod passes through the first hole of the first coupling piece, the second hole of the second coupling piece, and the third slot of the third coupling piece. The first and second coupling pieces are rotatable with respect to each other around the first rod, and the third coupling piece is movable with respect to the first rod between a first position where the first rod is at the bottom of the third slot of the third coupling piece and a second position where the first rod is at the top of the third slot of the third coupling piece. The second rod is integrally formed or coupled with a top portion of the third coupling piece, and movable together with the third coupling piece. When the second rod is disposed in both of the first slot of the first coupling piece and the second slot of the second coupling piece, the first and second coupling pieces are restricted from rotating with respect to each other. When the second rod is released from any one of the first slot of the first coupling piece and the second slot of the second coupling piece, the first and second coupling pieces are rotatable with respect to each other.

In some exemplary embodiments, each of the first and second coupling pieces includes a horizontal piece, a first lug at a first side of the horizontal piece and a second lug at a second side of the horizontal piece. The first and second lugs are substantially parallel to each other. Each of the first and second lugs is formed with a corresponding first or second hole and a corresponding first or second slot.

In an exemplary embodiment, the third coupling piece includes a third hole, wherein the second rod is coupled with the third coupling piece by passing through the third hole of the third coupling piece.

In some embodiments, the folding/unfolding mechanism further includes an elastic member disposed in an interior of the third coupling piece between the first rod and a bottom cover of the third coupling piece. The elastic member exerts a force on the first rod and the bottom cover of the third coupling piece, thereby positioning the third coupling piece at the second position where the first rod is at the top of the third slot of the third coupling piece.

In some exemplary embodiments, the frame further includes a first lateral bar, a second lateral bar, a plurality of legs, a plurality of oblique bars, and a plurality of sliders. The first lateral bar is disposed at a third side of the frame and having a first end pivotally connected with the first longitudinal bar and a second end pivotally connected with the second longitudinal bar. The second lateral bar is disposed at a fourth side of the frame and having a first end pivotally connected with the first longitudinal bar and a second end pivotally connected with the second longitudinal bar. Each leg in the plurality of legs has an end fixedly connected with the first or second lateral bar. Each oblique bar in the plurality of oblique bars has a first end and a second end. The first end of each respective oblique bar in the plurality of oblique bars is pivotally connected with a corresponding leg in the plurality of legs. Each slider in the plurality of sliders slidably coupled with the first or second longitudinal bar and pivotally coupled with the second end of an oblique bar in the plurality of oblique bars.

In some exemplary embodiments, each slider includes a sleeve, a pivoting portion and a controller. The sleeve is slidably coupled with the first or second longitudinal bar, wherein a first hole and a pillar are formed at the first side wall of the sleeve. The pivoting portion is integrally formed or coupled with the first side wall of the sleeve, and pivotally coupled with the second end of an oblique bar in the plurality of oblique bars. The controller is disposed side by side with the pivoting portion along a longitudinal direction of the sleeve, and configured to control movement of the sleeve along the first or second longitudinal bar. The controller includes a casing, a lever, a pin and an elastic member. The casing is integrally formed or coupled with the first side wall of the sleeve and surrounds the first hole and the pillar formed at the first side wall of the sleeve. The lever includes a first end portion, a second end portion and a middle portion between the first and second portions. The first end portion is aligned with the first hole formed at the first side wall of the sleeve, the second end portion is aligned with the pillar formed at the first side wall of the sleeve, and the middle portion is pivotally connected with the casing. The pin is integrally formed or coupled with the first end portion of the level, wherein the pin has a free end toward the first hole formed at the first side wall of the sleeve. The elastic member is engaged with the pillar formed at the first side wall of the sleeve, having a first end abutting the first side wall of the sleeve and a second end abutting the second portion of the lever. When the first hole formed at the first side wall of the sleeve aligns with a hole of the first or second longitudinal bar, the elastic member pushes the free end of the pin into the first hole formed at the first side wall of the sleeve and the hole of the first or second longitudinal bar, thereby restricting movement of the sleeve with respect to the first or second longitudinal bar.

In some exemplary embodiments, the frame further includes a plurality of stoppers. Each stopper in the plurality of stoppers is fixedly coupled with a longitudinal bar in the first the second longitudinal bars at a position between a lateral bar in the first and second lateral bars and a corresponding slider in the plurality of sliders, thereby preventing the corresponding slider from moving further toward the lateral bar and thus preventing the plurality of legs from rotating beyond its unfolded state.

In an exemplary embodiment, each respective stopper in the plurality of stoppers includes a protrusion, and a second side wall of the sleeve of the corresponding slider is formed with a notch at an end portion of the sleeve to receive the protrusion of the respective stopper.

In some exemplary embodiments, each of the first and second bars is formed with an oval or oblong hole at a distal end thereof, and each of the first and second lateral bars includes an end portion of an oval or oblong cross-section at each of the first and second sides of the frame to couple with the oval or oblong hole.

In some exemplary embodiments, each leg in the plurality of legs includes an upper leg and a lower leg telescopically connected with each other.

In an exemplary embodiment, each respective leg in the plurality of legs further includes a locking/unlocking mechanism fixedly coupled with the upper leg. The lower leg includes a plurality of holes along the longitudinal direction of the lower leg. The locking/unlocking mechanism includes a protrusion configured to be insertable into any one of the plurality of holes of the lower leg, thereby facilitating adjustment of a height of the respective leg.

In various exemplary embodiments, the present disclosure provides a table including a frame (any frame disclosed herein) and a tabletop coupled with the frame and supported by the frame when in use.

In some exemplary embodiments, the tabletop includes a first panel coupled with the first bars of the first and second longitudinal bars and a second panel coupled with the second bars of the first and second longitudinal bars to facilitate folding of the table in half.

The locking/unlocking mechanisms, folding/unfolding mechanisms, sliders, and frames and tables of the present disclosure have other features and advantages that will be apparent from, or are set forth in more detail in, the accompanying drawings, which are incorporated herein, and the following Detailed Description, which together serve to explain certain principles of exemplary embodiments of the present disclosure.

BRIEF DESCRIPTION OF THE DRAWINGS

The accompanying drawings, which are incorporated into and constitute a part of this specification, illustrate one or more exemplary embodiments of the present disclosure and, together with the Detailed Description, serve to explain the principles and implementations of exemplary embodiments of the invention.

Figure 1:
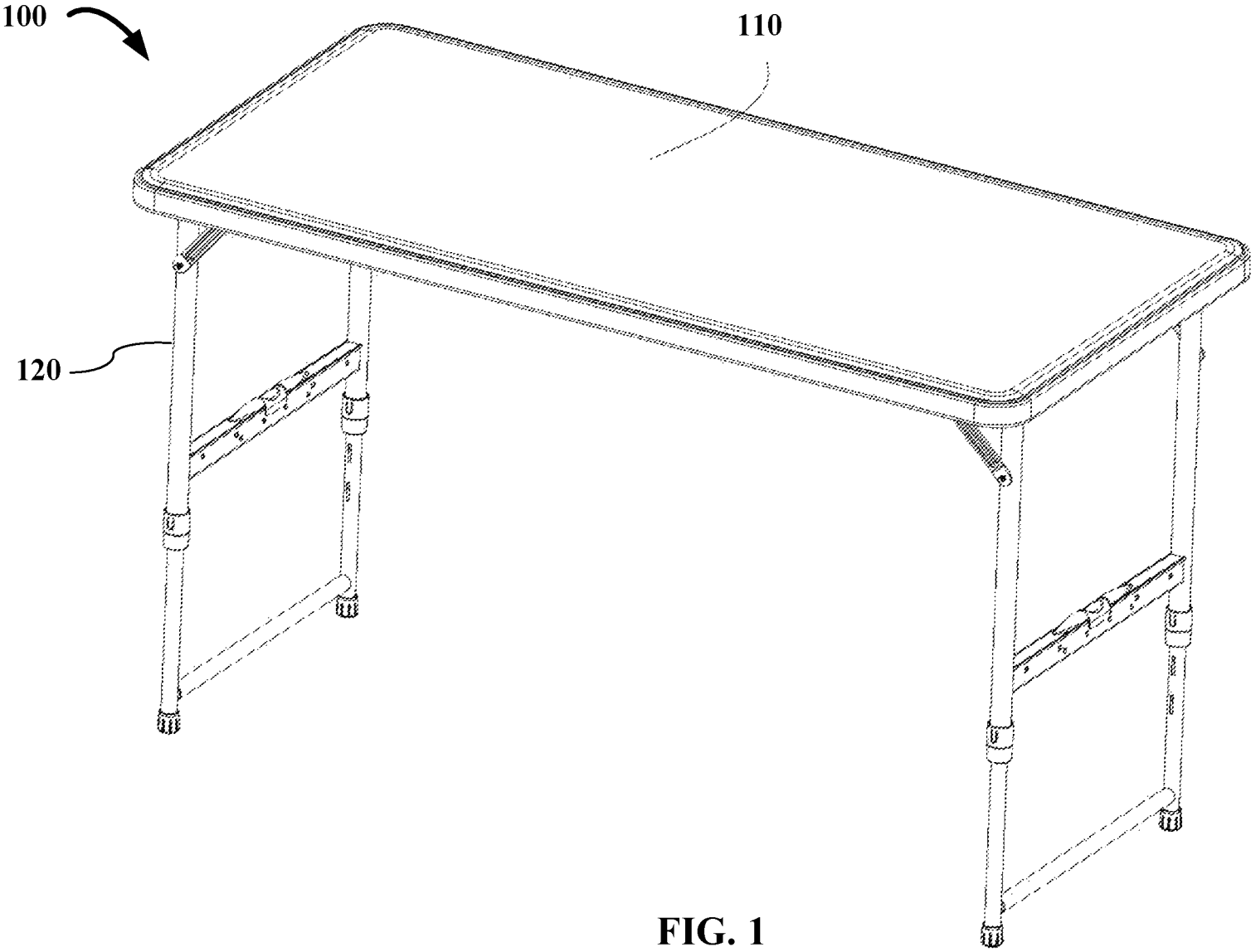
FIG. 1 is a top perspective view illustrating an exemplary table in accordance with exemplary embodiments of the present disclosure.

As will be apparent to those of skill in the art, the components illustrated in the figures described above are combinable in any useful number and combination. The figures are intended to be illustrative in nature and are not limiting.

DETAILED DESCRIPTION

Reference will now be made in detail to implementations of exemplary embodiments of the present disclosure as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present disclosure will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the exemplary embodiments, as will be apparent to those skilled in the art. The specific exemplary embodiments described herein are offered by way of example only, and the disclosure is to be limited only by the terms of the appended claims, along with the full scope of equivalents to which such claims are entitled.

Embodiments of the present disclosure are described in the context of folding/unfolding mechanisms, sliders, frames having folding/unfolding mechanisms, frames having sliders, frames having both folding/unfolding mechanisms and sliders, and tables having one or more such frames. The frames and tables of the present disclosure can be of various sizes. For instance, a frame of the present disclosure can be configured for a coffee table, a dining table, or the like, and can be of a square or rectangular shape. They can be made of various materials including but not limited to metals (e.g., iron, steel, and aluminum), plastics and woods.

Referring to FIGS. 1-5, there is depicted an exemplary table in accordance with some embodiments of the present disclosure. As shown, table 100 includes a tabletop such as tabletop 110 and a frame such as frame 120 coupled with the tabletop and supporting the tabletop when in use.

Frame 120 includes a first longitudinal bar such as first longitudinal bar 121*a* disposed at a first side of the frame and a second longitudinal bar such as second longitudinal bar 121*b* disposed at a second side of the frame and substantially parallel to the first longitudinal bar. It should be noted that the term "side" does not necessarily mean an outmost edge of a frame or an outmost edge of a table. In an exemplary embodiment, first longitudinal bar 121*a*, second longitudinal bar 121*b* or each of first longitudinal bar 121*a* and second longitudinal bar 121*b* is made of a unitary bar, and tabletop 110 is made of a unitary panel.

Frame 120 also includes a first lateral bar such as first lateral bar 122*a* disposed at a third side of the frame and a second lateral bar such as second lateral bar 122*b* disposed at a fourth side of the frame. Each of the first and second lateral bars has a first end pivotally connected with the first longitudinal bar and a second end pivotally connected with the second longitudinal bar.

Figure 2:
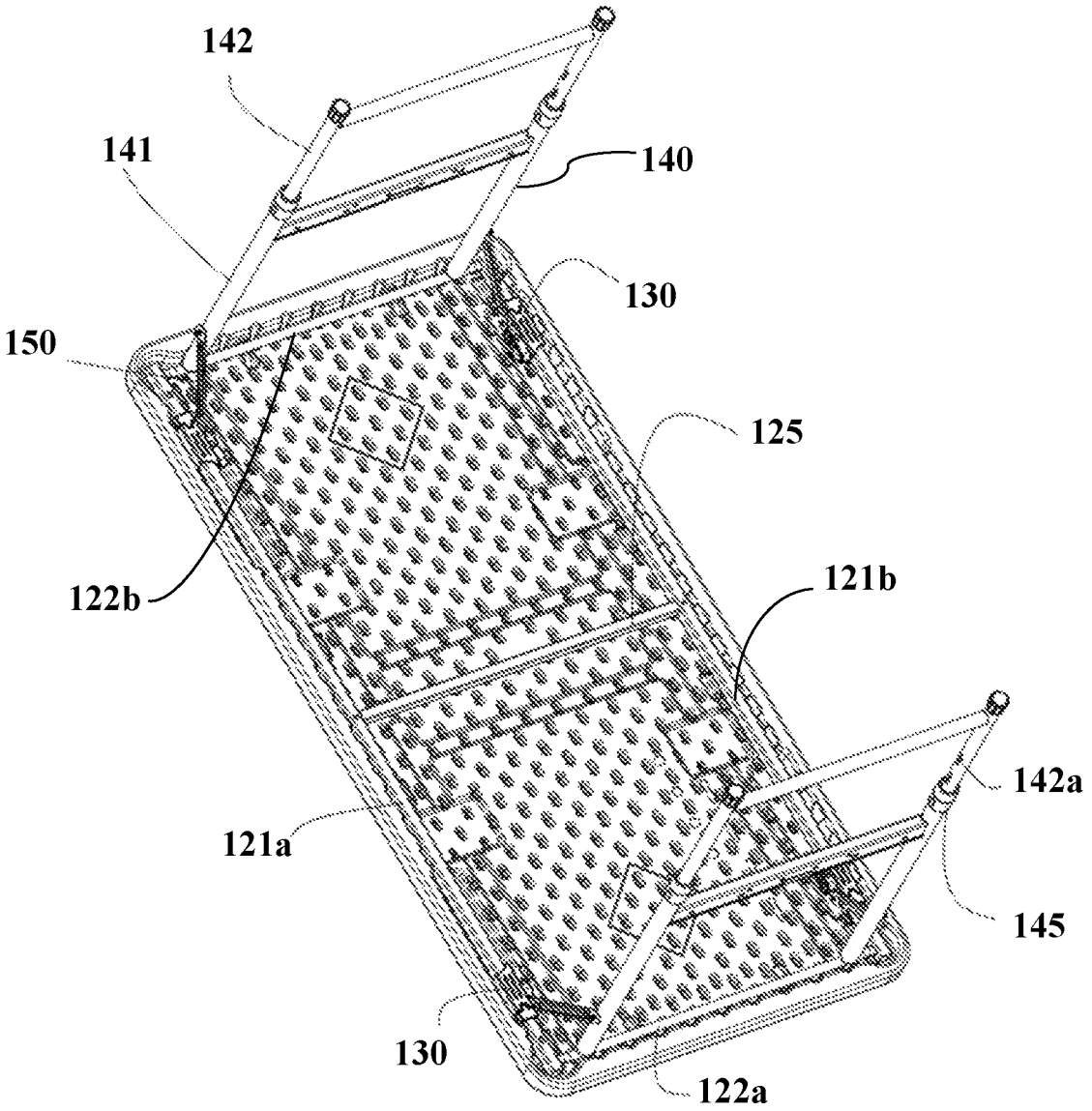
FIG. 2 is a bottom perspective view illustrating an exemplary frame in an unfolded state in accordance with exemplary embodiments of the present disclosure.
Figure 3:
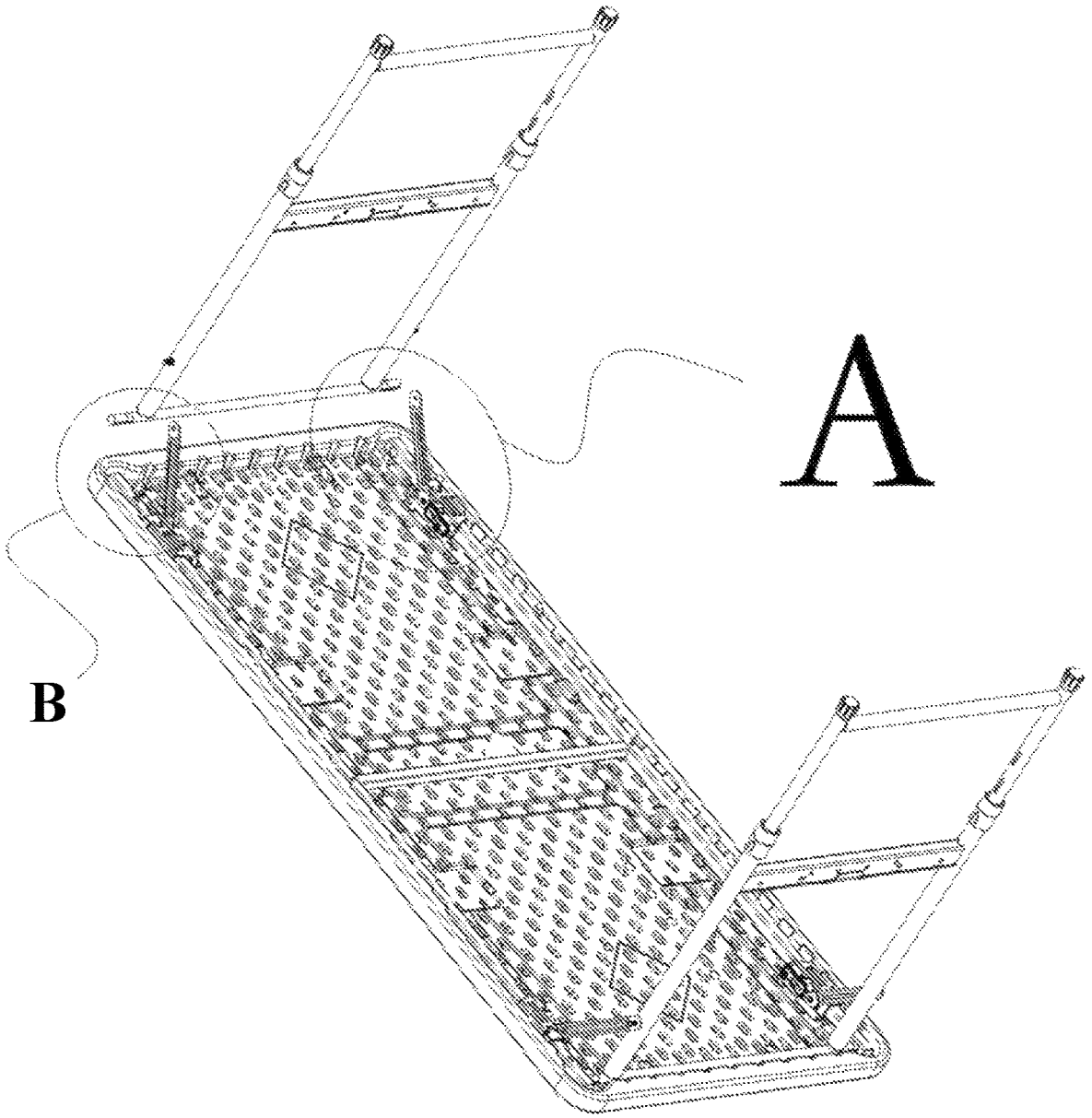
FIG. 3 is a partially disassembled view illustrating an exemplary table in an unfolded state in accordance with exemplary embodiments of the present disclosure.

In some exemplary embodiments, frame 120 includes one or more interior lateral bars spaced apart from the first and second lateral bars, and each interior lateral bar has a first end connected with the first longitudinal bar and a second end connected with the second longitudinal bar. For instance, by way of example, FIG. 2 illustrates frame 120 including interior lateral bar 125 disposed the first and second lateral bars and connected with the first and second longitudinal bars. In an exemplary embodiment, interior lateral bar 125 is disposed in the middle of the frame. It should be noted that the term "middle" as used herein does not necessarily mean the center of the frame.

Frame 120 further includes a plurality of legs such as legs 140, each having an end fixedly connected with the first or second lateral bar. For instance, in an exemplary embodiment, frame 120 includes four legs, two connected with the first lateral bar and two connected with the second lateral bar. In some exemplary embodiments, leg 140 has an upper leg such as upper leg 141 and a lower leg such as lower leg 142 that are telescopically connected with each other. For instance, in an exemplary embodiment, the lower leg is formed with a plurality of holes such as hole 142*a* along the longitudinal direction of the lower leg, and a locking/unlocking mechanism such as locking/unlocking mechanism 145 is fixedly coupled with the upper leg. The locking/unlocking mechanism includes a protrusion configured to be insertable into any one of the plurality of holes of the lower leg. Inserting the protrusion into different holes changes the length of the leg, and thus places the table at different heights.

Figure 4:
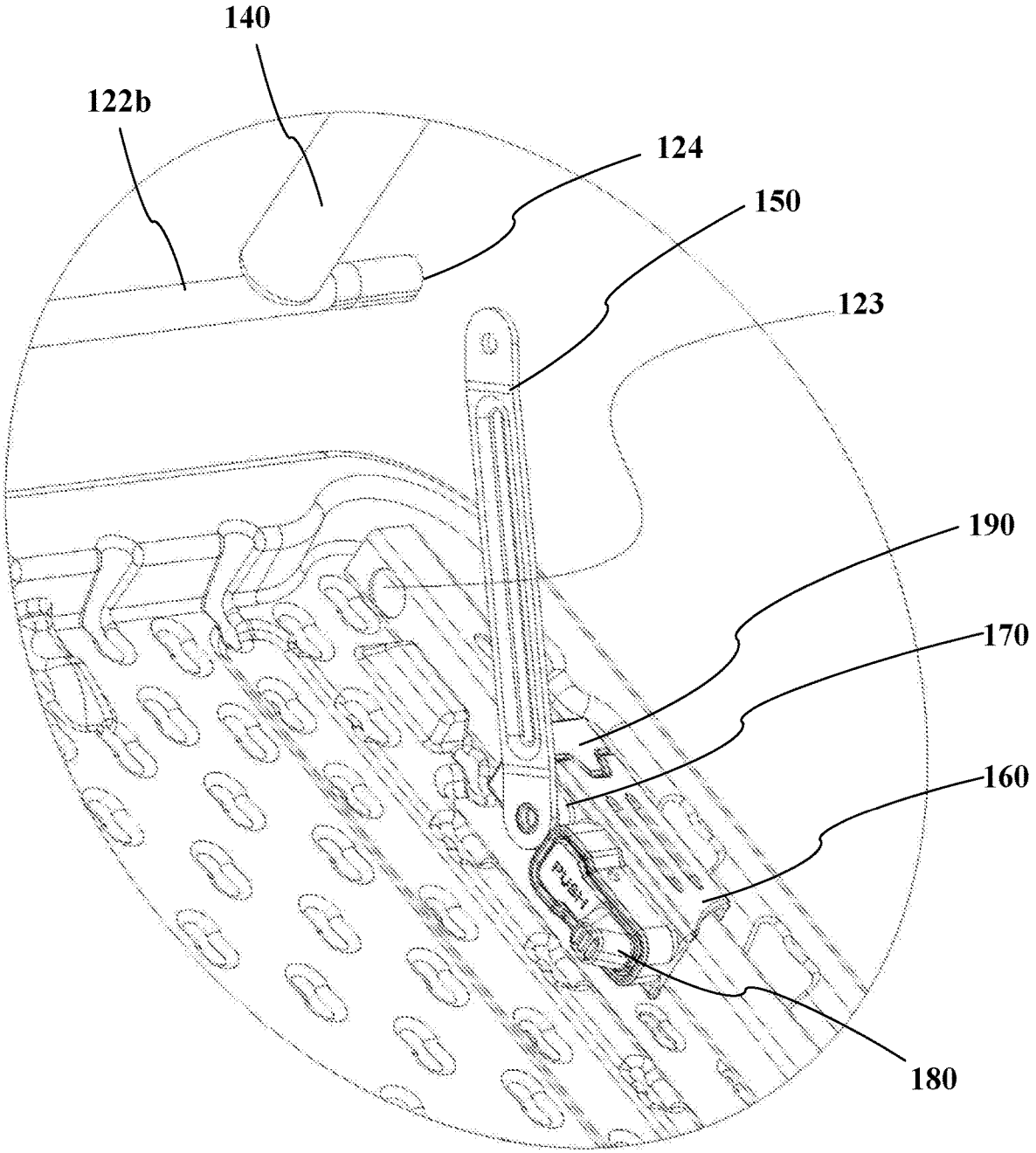
FIG. 4 is an enlarged view taken along circle A of FIG. 3.
Figure 5:
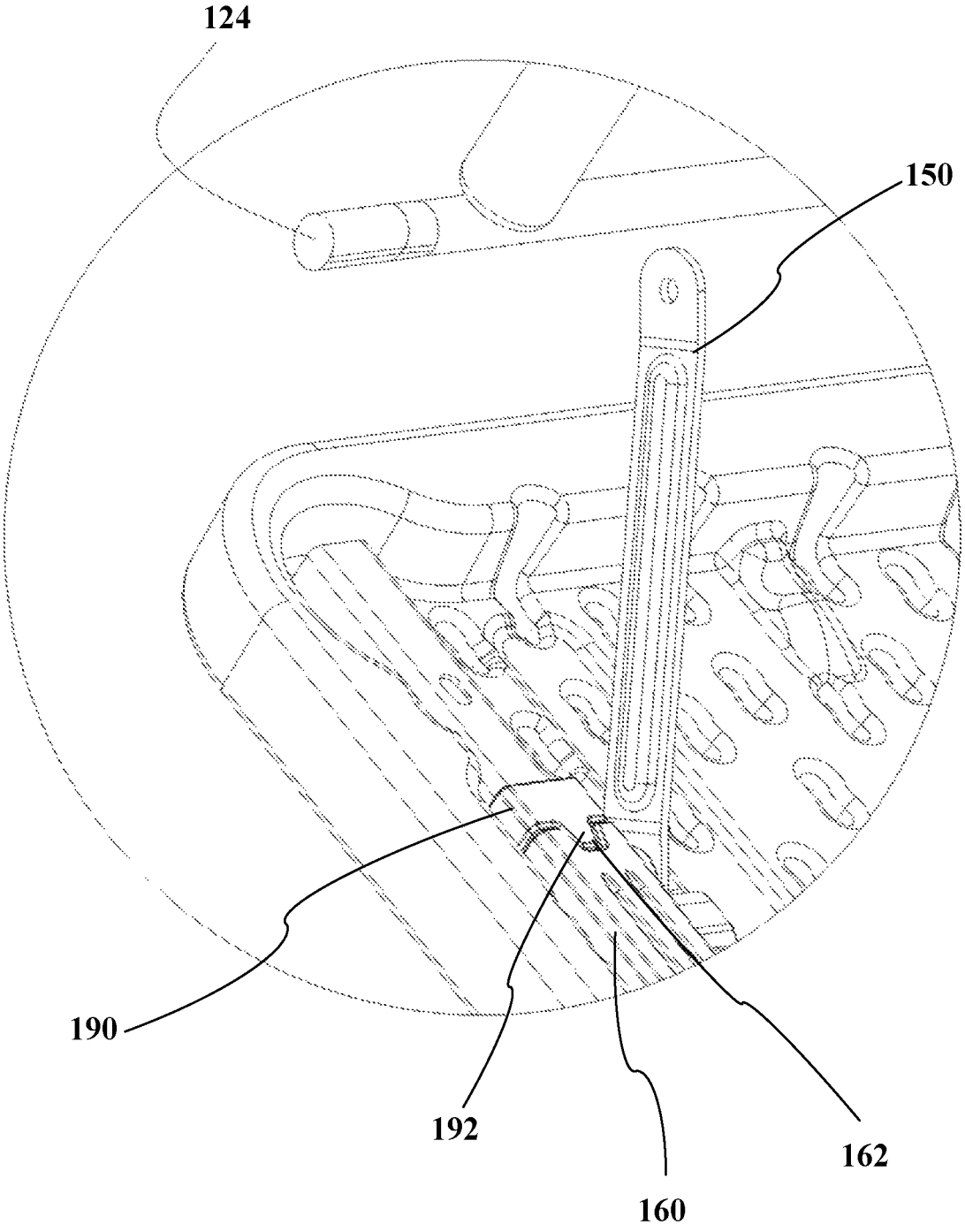
FIG. 5 is an enlarged view taken along circle B of FIG. 3.

Referring in particular to FIGS. 4 and 5, in some exemplary embodiments, each of the first and second longitudinal bars is formed with a hole such as hole 123 at each of the third and fourth sides of the frame (e.g., adjacent the two ends of the first or second longitudinal bar), and each of the first and second lateral bars includes an engaging portion such as engaging portion 124 configured to be inserted into the hole formed at the first or second longitudinal bar. In some exemplary embodiments, one of hole 123 and engaging portion 124 has an oval or oblong cross-section, or each of hole 123 and engaging portion 124 has an oval or oblong cross-section. For instance, in an exemplary embodiment, the width of hole 123 (e.g., in the longitudinal direction of the frame) is larger than the height of hole 123 (e.g., in the vertical direction of the frame), the width of engaging portion 124 is smaller than the height of engaging portion 124, and the height of engaging portion 124 matches with the height of hole 123. As such, the lateral and longitudinal bars are loosely coupled with each other when the leg is folded onto the tabletop, and the lateral and longitudinal bars are tightly coupled with each other when the leg is unfolded and supports the tabletop. This configuration makes it easy to fold and unfold the legs and helps to stabilize the table when in use.

To further enhance the strength and stability of the table, in various exemplary embodiments, frame 120 includes a plurality of oblique bars such as oblique bar 150 and a plurality of sliders such as slider 130. For instance, in an exemplary embodiment, frame 120 includes four oblique bars 150 and four sliders 130. Each oblique bar 150 has one end pivotally connected with a corresponding leg and the other end pivotally connected with a corresponding slider that is slidably coupled with the first or second longitudinal bar.

Slider 130 includes a sleeve such as sleeve 160 configured to slidably couple with the first longitudinal bar 121*a* or the second longitudinal bar 121*b*. It should be noted that the sleeve can couple with any suitable bars including but not limited the first and second longitudinal bars disclosed herein, and accordingly slider 130 can be used in applications including but not limited to table frames disclosed herein. For instance, slider 130 can be used in other furniture such as chairs, beds or the like. Slider 130 also includes a pivoting portion such as pivoting portion 170 configured to pivotally couple with a bar such as oblique bar 150. Slider 130 further includes a control mechanism such as controller 180 that selectively allows the slider to move along the first or second longitudinal bar or restricts the slider from moving with respect to the first or second longitudinal bar. In an exemplary embodiment, controller 180 of each slider is disposed in an interior defined by the first longitudinal bar, the second longitudinal bar, the first lateral bar and the second lateral bar.

In some exemplary embodiments, frame 120 further includes a plurality of stoppers such as stoppers 190. Each stopper is fixedly coupled with a longitudinal bar (e.g., the first or second longitudinal bar) at a position between a lateral bar (e.g., the first or second lateral bar) and a corresponding slider. As such, stopper 190 sets a limit and prevents the corresponding slider from moving further toward the lateral bar. As a result, this prevents the plurality of legs from rotating beyond its unfolded state. In an exemplary embodiment, stopper 190 is formed with a protrusion such as protrusion 192, and sleeve 160 of slider 130 is formed with a notch such as notch 162 to receive the protrusion of the respective stopper. This further enhances the stability of the table when in use.

Figure 6:
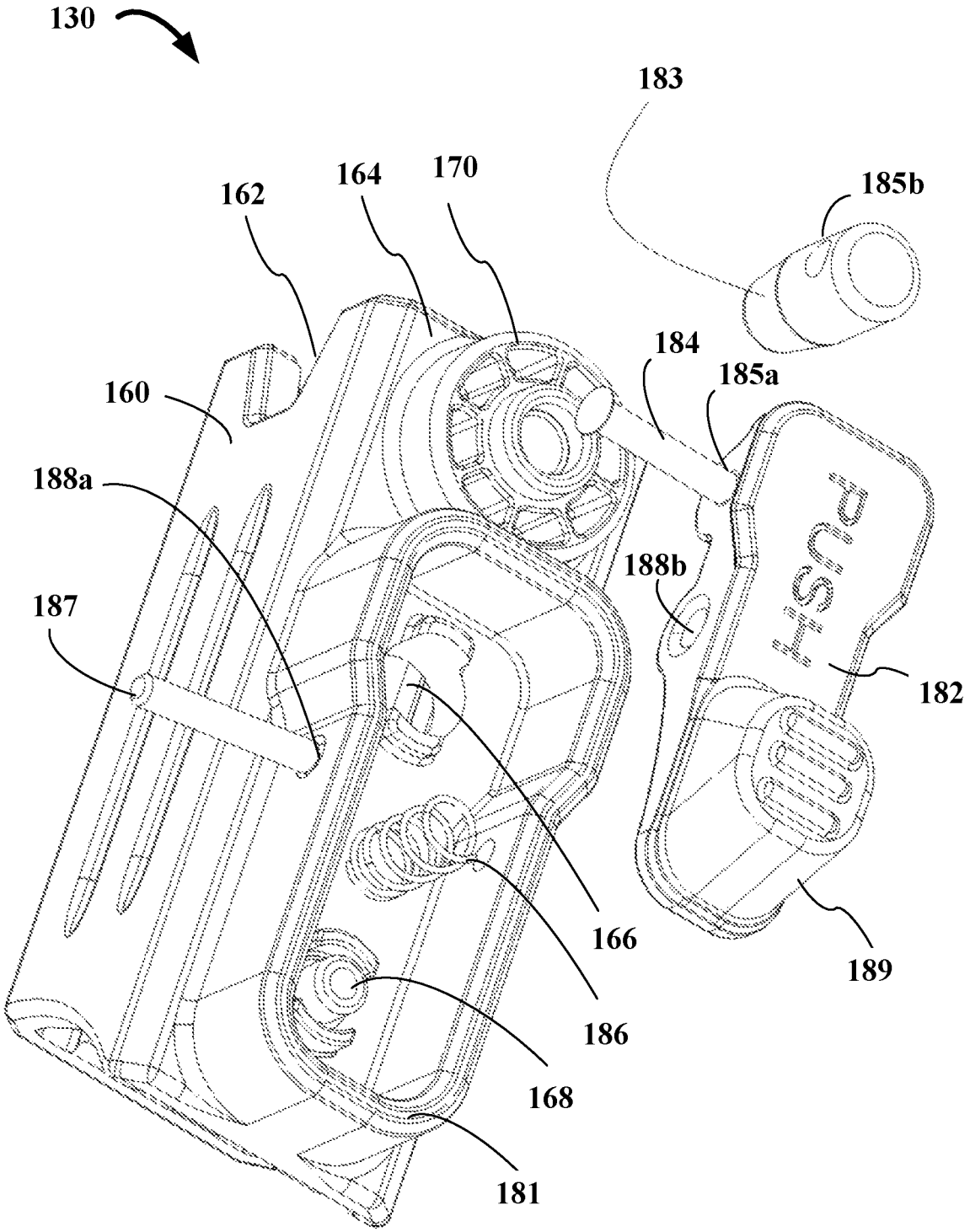
FIG. 6 is a disassembled view illustrating an exemplary slider in accordance with exemplary embodiments of the present disclosure.

Referring to FIG. 6, there is depicted an exemplary slider in accordance with some exemplary embodiments of the present disclosure. In some exemplary embodiments, sleeve 160 includes a first side wall such as first side wall 164, where a hole such as hole 166 and a pillar such as pillar 168 are formed at first side wall 164. In some exemplary embodiments, hole 166 and pillar 168 are formed at the first side wall of the sleeve side by side along the longitudinal direction of the sleeve. In an exemplary embodiment, hole 166 is formed at a middle portion of the first side wall of the sleeve.

In some exemplary embodiments, pivoting portion 170 is integrally formed (e.g., by molding) or coupled (e.g., glued or fastened) with the first side wall of the sleeve. Controller 180 is disposed side by side with the pivoting portion along a longitudinal direction of the sleeve, and configured to control movement of the sleeve along the bar (e.g., the first or second longitudinal bar). In an exemplary embodiment such as that illustrated in FIG. 6, notch 162 is formed on a side wall other than the first side wall of the sleeve.

In some exemplary embodiments, controller 180 includes casing 181 integrally formed (e.g., by molding) or coupled (e.g., glued or fastened) with the first side wall of the sleeve. Casing 181 can have any suitable shapes provided that it encloses or surrounds hole 166 and pillar 168 formed at first side wall 164. In an exemplary embodiment, casing 181 is formed by a circumferential wall extended from the first side wall of the sleeve, e.g., a portion of the first side wall serves as the bottom of casing 181.

Controller 180 also includes a lever such as lever 182 pivotally connected with casing 181. For instance, in some exemplary embodiments, lever 182 includes a first end portion aligned with hole 166 of the sleeve, a second end portion aligned with pillar 168 of the sleeve, and a middle portion between the first and second portions. In an exemplary embodiment, the middle portion of the lever is pivotally connected with the casing by a rod such as rod 187 passing through a hole such as hole 188*a* formed at the casing and a hole such as hole 188*b* formed at the middle portion of the lever.

Controller 180 also includes a pin such as pin 183 integrally formed or coupled with the first end portion of the level and having a free end toward hole 166 formed at the first side wall of the sleeve. For instance, in an exemplary embodiment, pin 183 is coupled with the first end portion of the lever by a rod such as rod 184 that passes a hole such as hole 185*a* formed at the first portion of the lever and a hole such as hole 185*b* formed at the pin.

Controller 180 further includes an elastic member such as elastic member 186 engaged with pillar 168 formed at the first side wall of the sleeve. Elastic member 186 has a first end abutting the bottom of the casing (e.g., the first side wall of the sleeve) and a second end abutting the second portion of the lever. Thus, when hole 166 formed at the first side wall of the sleeve aligns with a hole of the first or second longitudinal bar, elastic member 186 pushes the free end of pin 183 into hole 166 and the hole at the first or second longitudinal bar, thereby restricting the sleeve (and accordingly the slider) from moving along the first or second longitudinal bar.

Pressing the second portion of the lever toward the sleeve will remove the free end of pin 183 from the hole at the first or second longitudinal bar or from the hole at the first or second longitudinal bar and hole 166 formed at the first side wall of the sleeve. This disengages the sleeve from the first or second longitudinal bar, and thus allows the sleeve (accordingly the slider) to move along the first or second longitudinal bar. In some exemplary embodiments, the second portion of the lever includes a protrusion such as protrusion 189 that is protruded outside of the casing to facilitate easy pressing of the second portion of the lever.

Referring now to FIGS. 7-14, there is depicted an exemplary folding/unfolding mechanism in accordance with some embodiments of the present disclosure. In general, a folding/unfolding mechanism of the present disclosure includes first and second coupling pieces configured to be fixed respectively at proximal ends (e.g., the middle in FIG. 7) of first and second bars. The folding/unfolding mechanism also includes a third coupling piece, and two rods to control the movement of the first and second coupling pieces.

Figure 7:
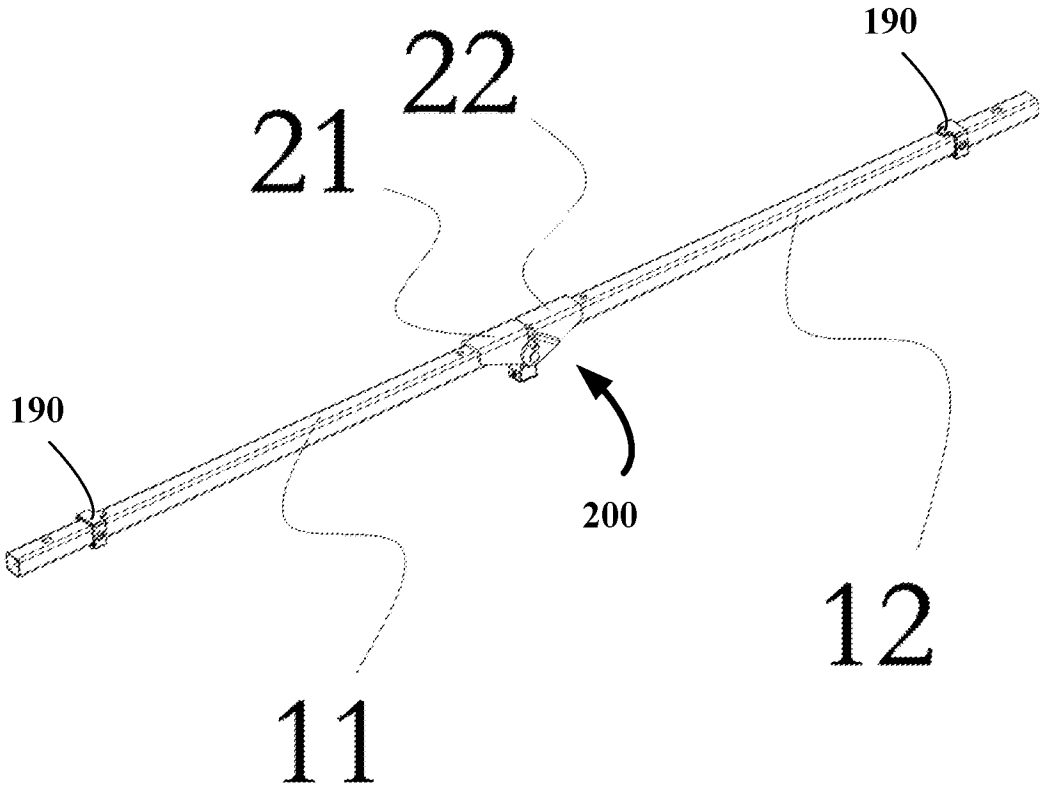
FIG. 7 is a perspective view illustrating an exemplary folding/unfolding mechanism in an unfolded state in accordance with exemplary embodiments of the present disclosure.
Figure 10:
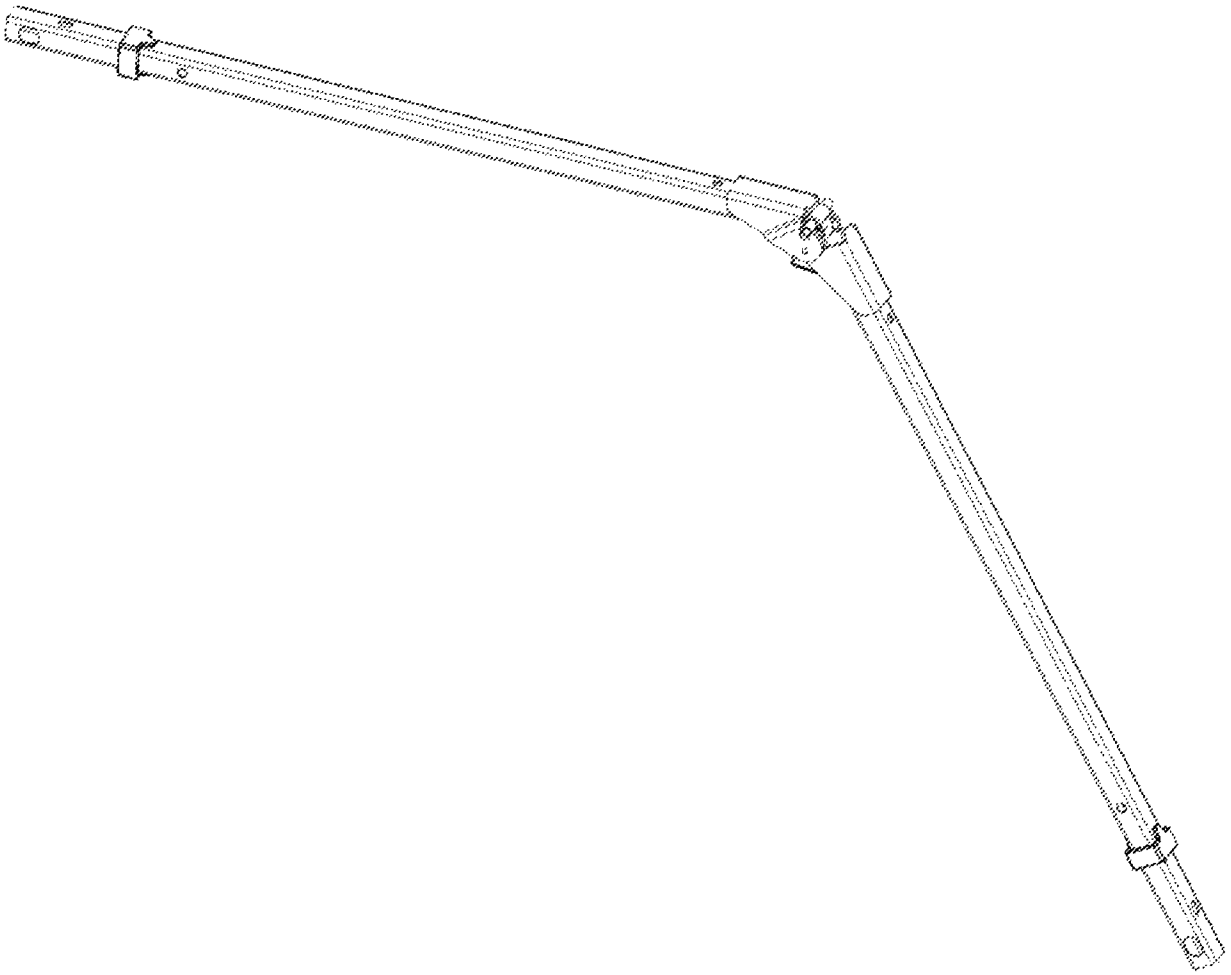
FIG. 10 is a second perspective view illustrating the exemplary folding/unfolding mechanism of FIG. 7 in an intermediate state in accordance with exemplary embodiments of the present disclosure.
Figure 11:
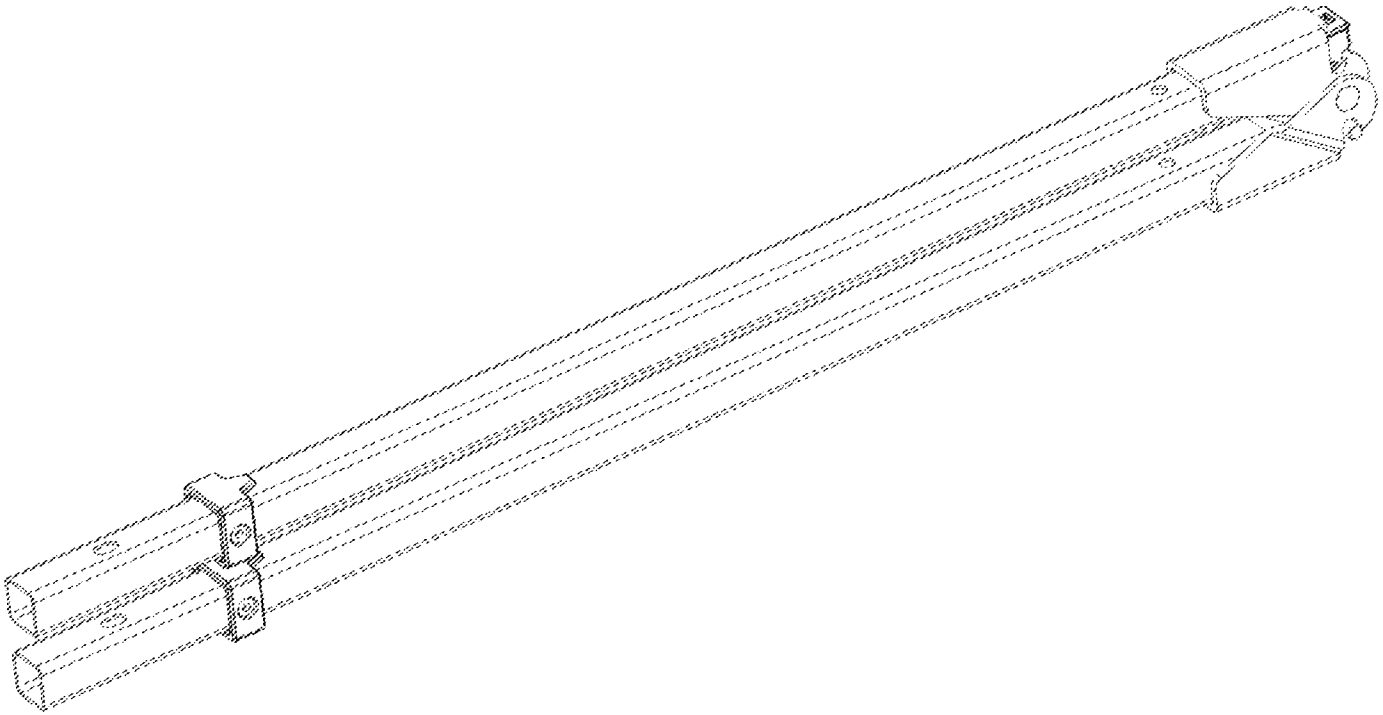
FIG. 11 is a perspective view illustrating the exemplary folding/unfolding mechanism of FIG. 7 in a folded state in accordance with exemplary embodiments of the present disclosure.
Figure 12:
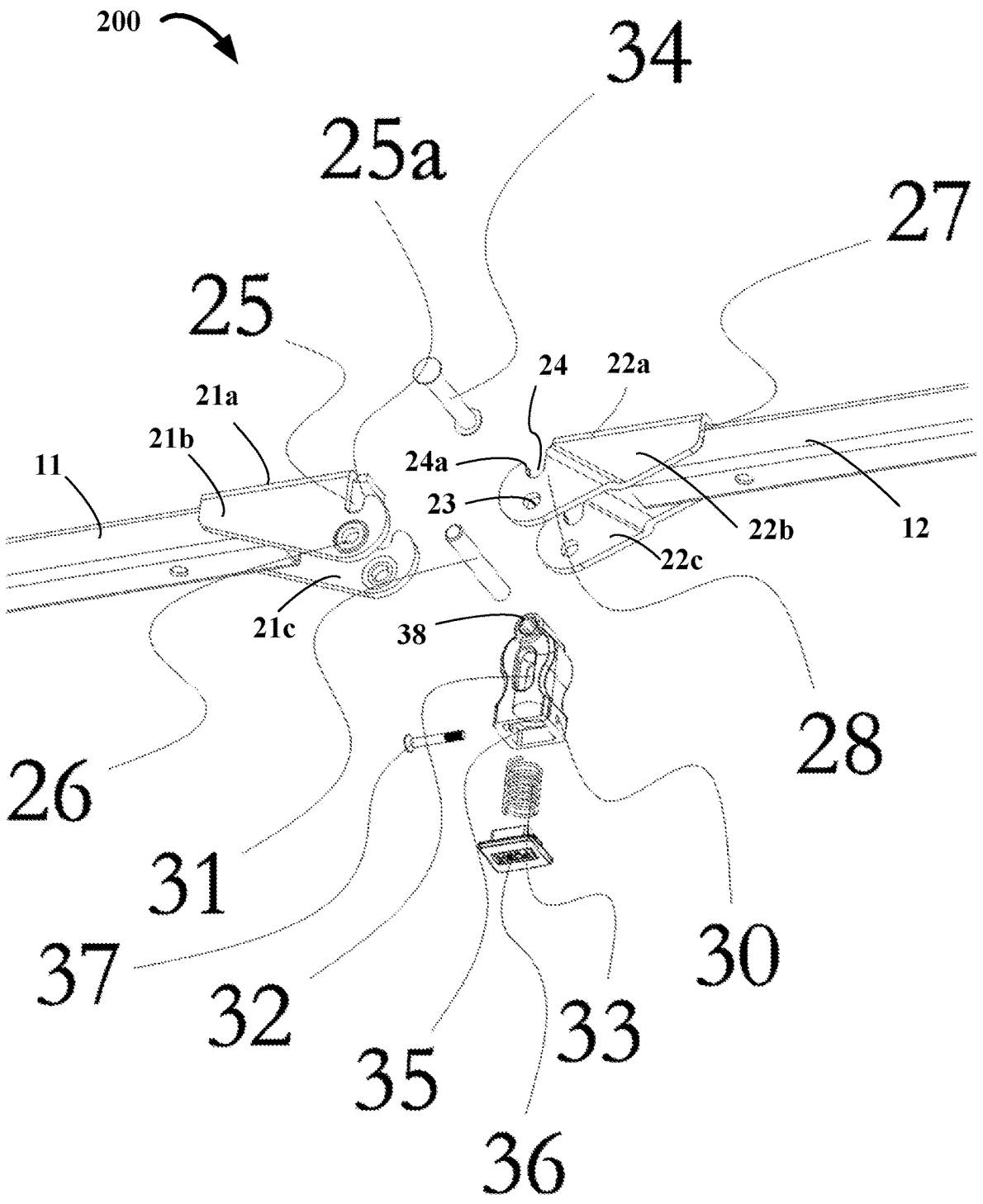
FIG. 12 is a disassembled view illustrating the exemplary folding/unfolding mechanism of FIG. 7 in accordance with exemplary embodiments of the present disclosure.
Figure 13:
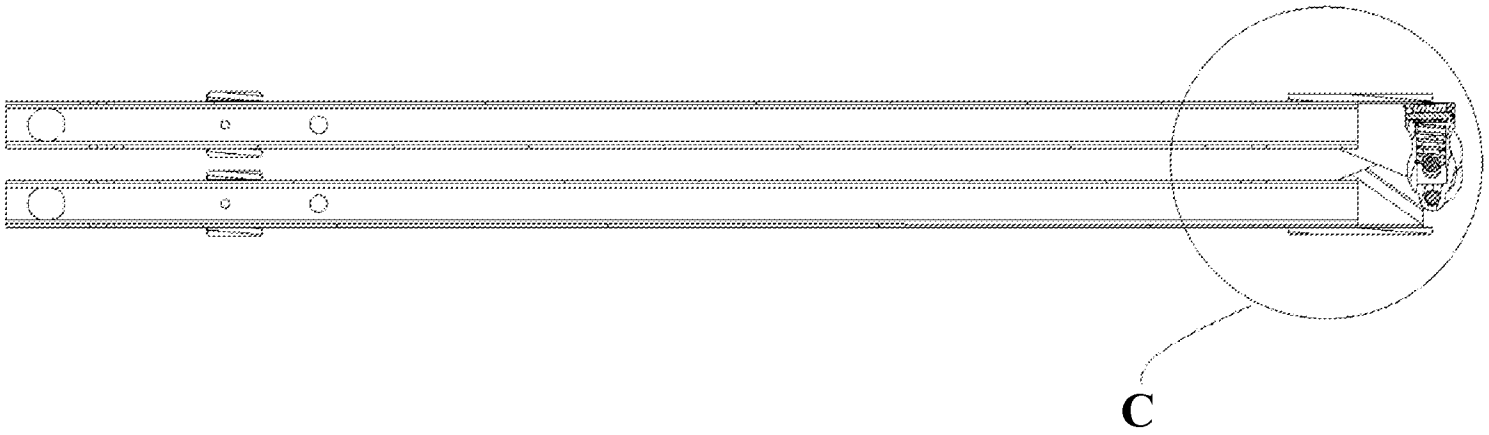
FIG. 13 is a cross-sectional view illustrating the exemplary folding/unfolding mechanism of FIG. 7 in a folded state in accordance with exemplary embodiments of the present disclosure.
Figure 14:
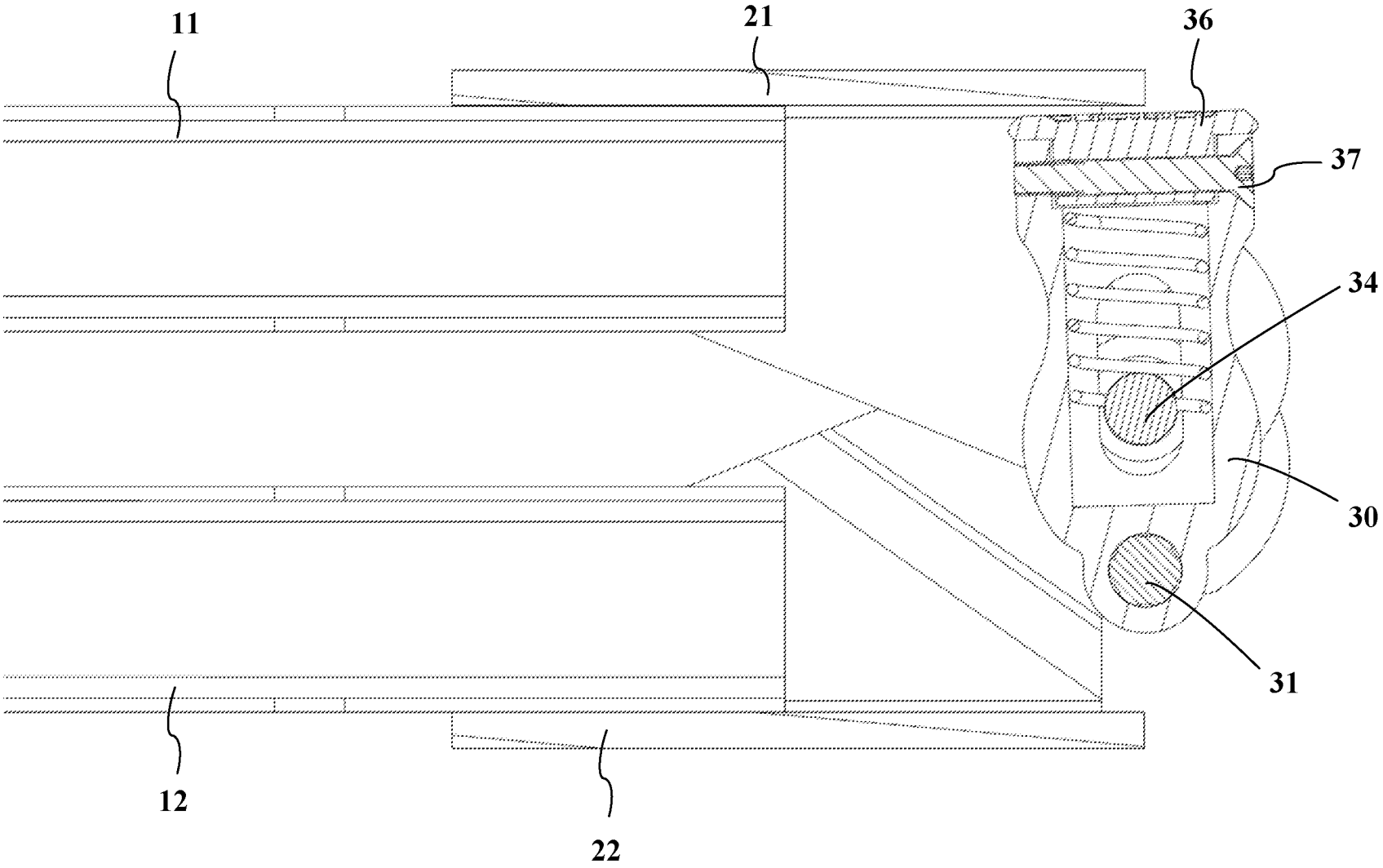
FIG. 14 is an enlarged view taken along circle C of FIG. 13.
Figure 15:
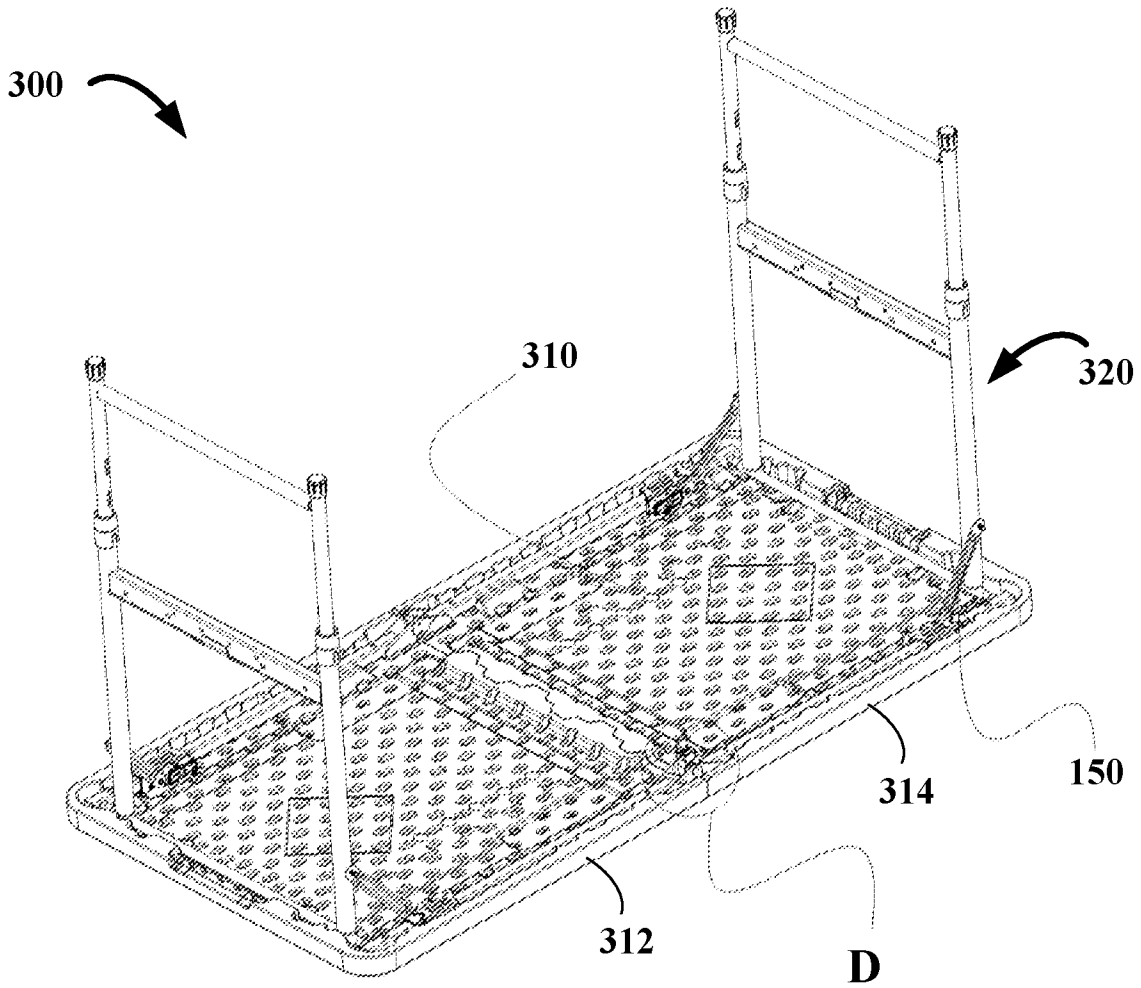
FIG. 15 is a bottom perspective view illustrating an exemplary table in an unfolded state in accordance with exemplary embodiments of the present disclosure.
Figure 16:
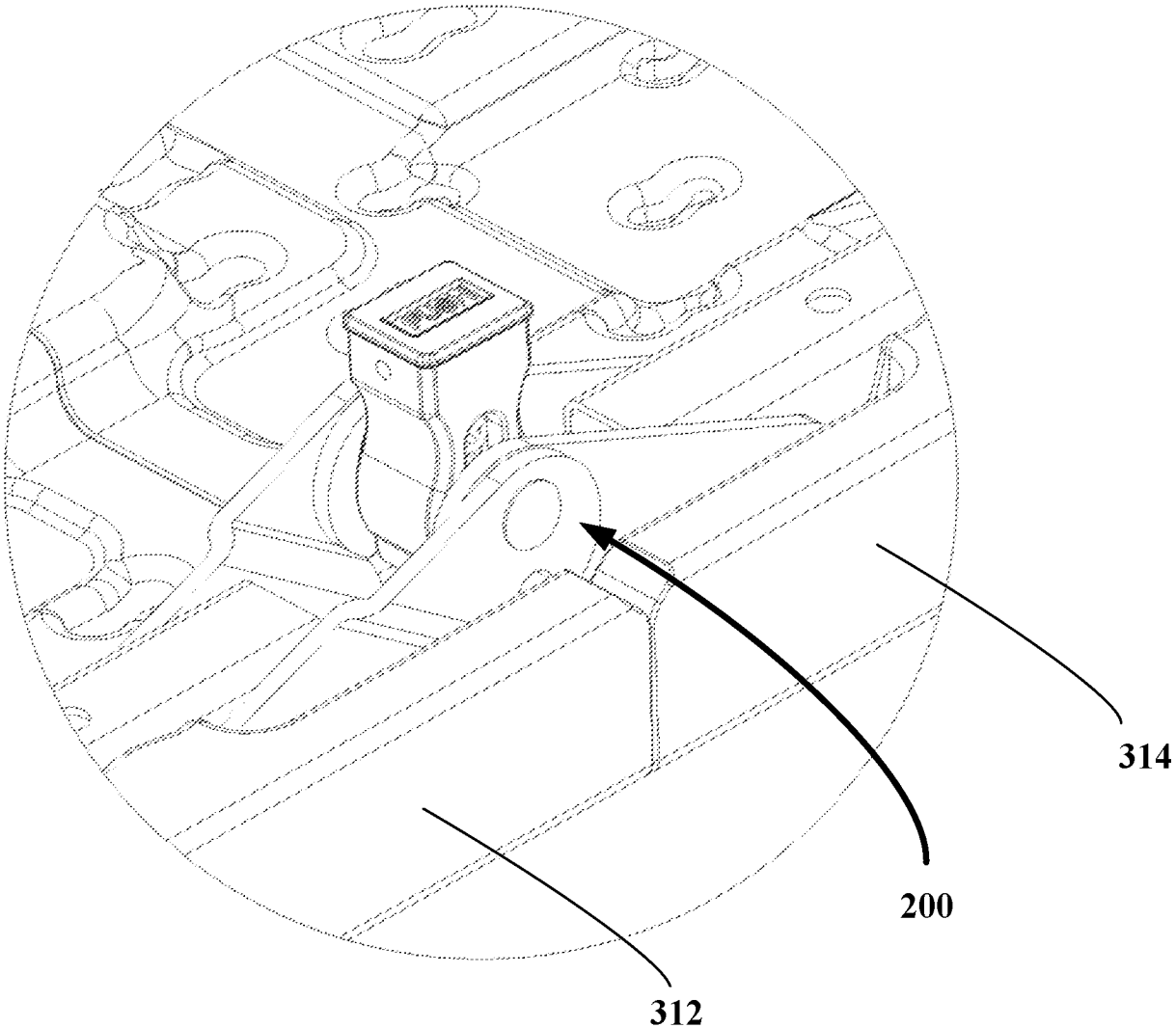
FIG. 16 is an enlarged view taken along circle D of FIG. 15.

Referring in particular to FIGS. 7, 12 and 14, an exemplary folding/unfolding mechanism such as folding/unfolding mechanism 200 includes a first coupling piece such as first coupling piece 21, a second coupling piece such as second coupling piece 22, a third coupling piece such as third coupling piece 30, and two rods such as rod 31 and rod 34. First coupling piece 21 is configured to be fixedly coupled with first bar 11 at an end of the first bar, for instance, by welding, bolting or the like. Second coupling piece 22 is configured to be fixedly coupled with second bar 12 at an end of the second bar, for instance, by welding, bolting or the like. The first and second bars can be configured the same of differently, e.g., having the same or different lengths, shapes, sizes, or made of the deficient materials. By way of illustration, FIGS. 7-14 show the first and second bars having substantially the same shape and length.

In some exemplary embodiments, first coupling piece 21 is formed with a hole such as hole 26 and a slot such as slot 25 above hole 26 (not necessarily directly above; it can have an offset in the vertical or horizontal direction or in both directions). Slot 25 has a closed bottom and an open top. Similarly, in some exemplary embodiments, second coupling piece 22 is formed with a hole such as hole 23 and a slot such as slot 24 above hole 23 (not necessarily directly above; it can have an offset in the vertical or horizontal direction or in both directions). Slot 24 has a closed bottom and an open top.

Third coupling piece 30 is formed with a slot such as slot 32. Slot 32 has a closed bottom and a closed top. In some exemplary embodiments, the first, second and third coupling pieces are connected with each other by rod 34 that passes through hole 26 of the first coupling piece, hole 23 of the second coupling piece, and slot 32 of the third coupling piece. Such a connection allows the first and second coupling pieces to rotate with respect to each other around rod 34, and allows the third coupling piece to move with respect to rod 34 between a first position where rod 34 is at the bottom of slot 32 of the third coupling piece and a second position where rod 34 is at the top of slot 32 of the third coupling piece.

Rod 31 is integrally formed or coupled with a top portion of third coupling piece 30, and movable together with the third coupling piece. For instance, in an exemplary embodiment, third coupling piece 30 is formed with a hole such as hole 38, and rod 31 is coupled with the third coupling piece by passing through hole 38 of the third coupling piece. Moving third coupling piece 30 with respect to rod 34 can place rod 31 into slot 25 of the first coupling piece and slot 24 of the second coupling piece, or release rod 31 from slot 25 of the first coupling piece or from slot 24 of the second coupling piece or from both of slot 25 of the first coupling piece and slot 24 of the second coupling piece. When rod 31 is disposed in both of slot 25 of the first coupling piece and slot 24 of the second coupling piece, the first and second coupling pieces are restricted from rotating with respect to each other. When rod 31 is released from one or more of slot 25 of the first coupling piece and slot 24 of the second coupling piece, the first and second coupling pieces are rotatable with respect to each other.

In some exemplary embodiments, the open top of slot 25 is curved, e.g., including curved edge 25*a*, and the open top of slot 24 is curved, e.g., including curved edge 24*a*. This configuration facilitates easy insertion of rod 31 into slot 24 and slot 25 and easy release of rod 31 from slot 24 and slot 25.

In some exemplary embodiments, first coupling piece 21 includes a horizontal piece such as horizontal piece 21*a*, a first lug such as first lug 21*b* at a first side of the horizontal piece and a second lug such as second lug 21*c* at a second side of the horizontal piece. The first and second lugs of the first coupling piece are substantially parallel to each other, and each is formed with a hole such as hole 26 and a slot such as slot 25. Similarly, in some exemplary embodiments, second coupling piece 22 includes a horizontal piece such as horizontal piece 22*a*, a first lug such as first lug 22*b* at a first side of the horizontal piece and a second lug such as second lug 22*c* at a second side of the horizontal piece. The first and second lugs of the second coupling piece are substantially parallel to each other, and each is formed with a hole such as hole 23 and a slot such as slot 24.

In some exemplary embodiments, at proximal end portions of the first and second coupling pieces, a distance between the first and second lugs of the first coupling piece is smaller than a distance between the first and second lugs of the second coupling piece. For instance, in an exemplary embodiment, proximal portions 28 of the first and second lugs of the second coupling piece are bended outwardly with respect to distal portions 27 of the first and second lugs of the second coupling piece such that a distance between proximal portions 28 is wider than a distance between distal portions 27. In such embodiments, at least a portion of the first and second lugs of the first coupling piece is disposed between the first and second lugs of the second coupling piece, and at least a portion of the third coupling piece is disposed between the first and second lugs of the first coupling piece, and at least a portion of the first and second lugs of the first coupling piece is disposed between the first and second lugs of the second coupling piece.

In some exemplary embodiments, third coupling piece 30 is formed with a cavity such as cavity 35. Elastic member 33 (e.g., spring) is disposed in the cavity and enclosed by a cover such as cover 36. Cover 36 is coupled with the third coupling piece, for instance, by a fastener such as fastener 37 or by snap fitting or the like. When assembled, elastic member 33 is disposed between rod 34 and cover 36, and has one end abutting rod 34 and another end abutting cover 36. Under normal conditions (e.g., without an external force), the third coupling piece is generally positioned by the elastic force of elastic member 33 at the second position where rod 34 is disposed at the top of slot 32 of the third coupling piece. An external force (e.g., by pushing or pressing the cover or the third coupling piece) is required to move the third coupling piece from the second position toward the first position, where rod 34 is disposed at the bottom of slot 32 of the third coupling piece.

Figure 8:
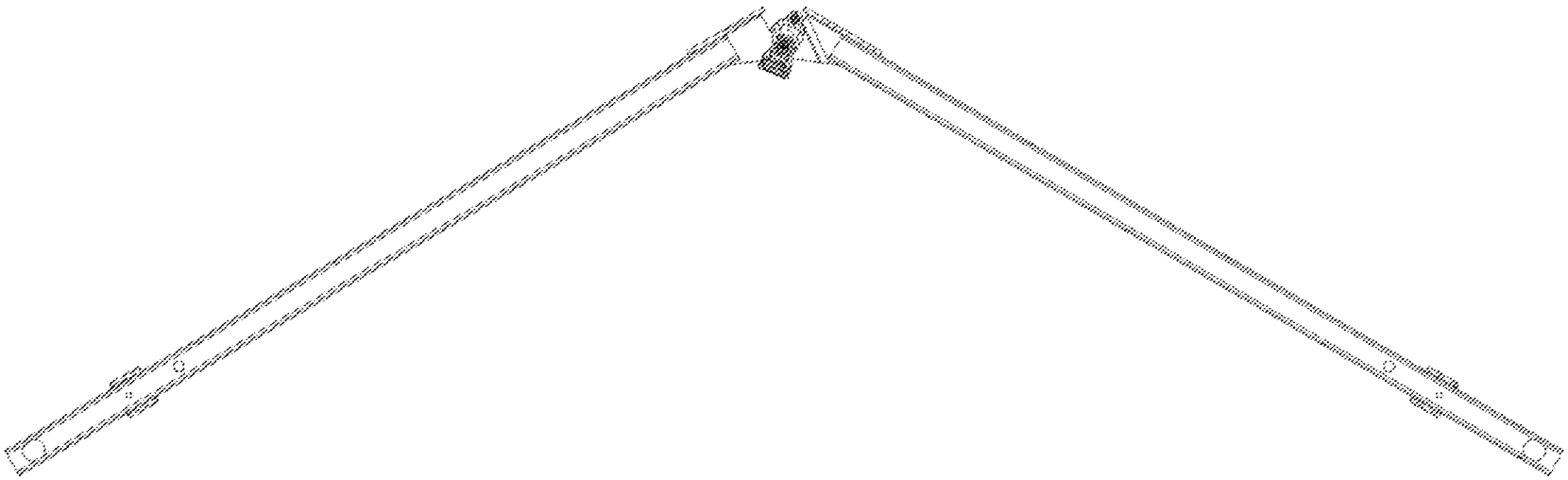
FIG. 8 is a cross-sectional view illustrating the exemplary folding/unfolding mechanism of FIG. 7 in an intermediate state in accordance with exemplary embodiments of the present disclosure.
Figure 9:
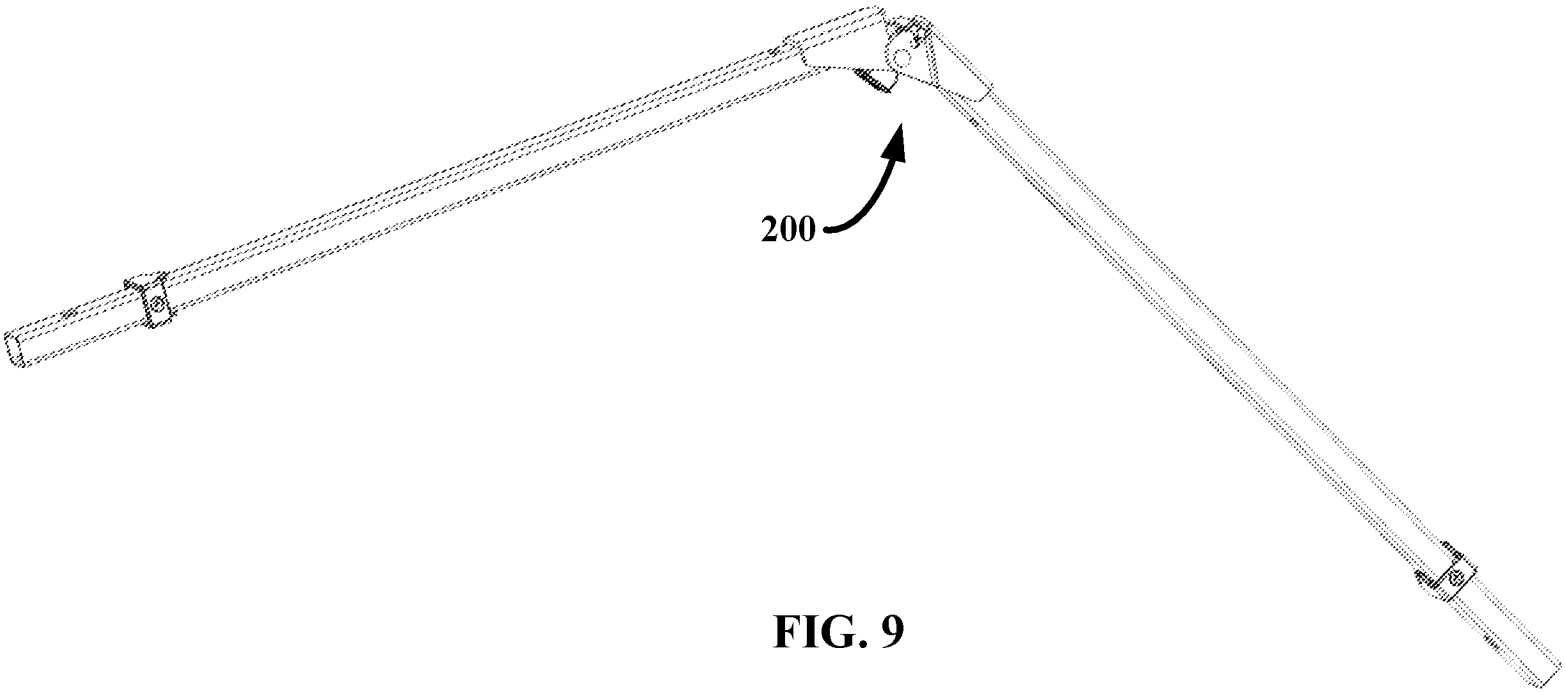
FIG. 9 is a first perspective view illustrating the exemplary folding/unfolding mechanism of FIG. 7 in an intermediate state in accordance with exemplary embodiments of the present disclosure.

Folding/unfolding mechanism 200 selectively allows the first and second bars to fold and unfold. For instance, from the unfolded state as illustrated in FIG. 7, one can push third coupling piece 30 toward the slots of the first and second coupling pieces (e.g. by pressing cover 36 upwardly in FIG. 7). Since it moves along with third coupling piece 30, rod 31 is pushed towards the open tops of the slots of the first and second coupling pieces, and eventually released from slot 25 of the first coupling piece or from slot 24 of the second coupling piece or from both of the slots of the first and second coupling pieces. This unlocks the first and second coupling pieces, and thus allows the first and second coupling pieces (accordingly the first and second bars) to rotate freely around rod 34 as illustrated in FIGS. 8-10. At the folded state, elastic member 33 abuts cover 36 and thus pulls the third coupling piece back such that rod 31 is disposed at the closed bottom of slot 25 of the first coupling piece, or at the closed bottom of slot 24 of the second coupling piece. By way of example, FIGS. 11, 13 and 14 illustrate rod 31 disposed at the closed bottom of slot 24 of the second coupling piece when folded. To unfold the first and second bars, one can rotate one or more of the first and second bars and then push the third coupling piece. When the slots of the first and second bars are aligned with each other, release the third coupling piece. Due to the elastic force of elastic member 33, the third coupling piece is pulled back such that rod 31 is inserted into slot 25 of the first coupling piece and slot 24 of the second coupling piece. This locks the first and second coupling pieces and thus restricts the first and second bars from rotating with respect to each other.

Referring to FIGS. 15-19, there is depicted another exemplary table in accordance with some embodiments of the present disclosure. As shown, table 300 includes a tabletop such as tabletop 310 and a frame such as frame 320 coupled with the tabletop and supporting the tabletop when in use. In some exemplary embodiments, tabletop 310 includes a first panel such as first panel 312 and a second panel such as second panel 314 disposed side by side when the table is unfolded.

Frame 320 includes a first longitudinal bar such as first longitudinal bar 321*a* disposed at a first side of the frame and a second longitudinal bar such as second longitudinal bar 321*b* disposed at a second side of the frame and substantially parallel to the first longitudinal bar. In some exemplary embodiments, each of first longitudinal bar 321*a* and second longitudinal bar 321*b* includes a first bar such as first bar 11 and a second bar such as second bar 12 pivotally connected with each other. As such, frame 320 and thus table 300 can be folded in half, making it easy for transportation and storage.

Figure 17:
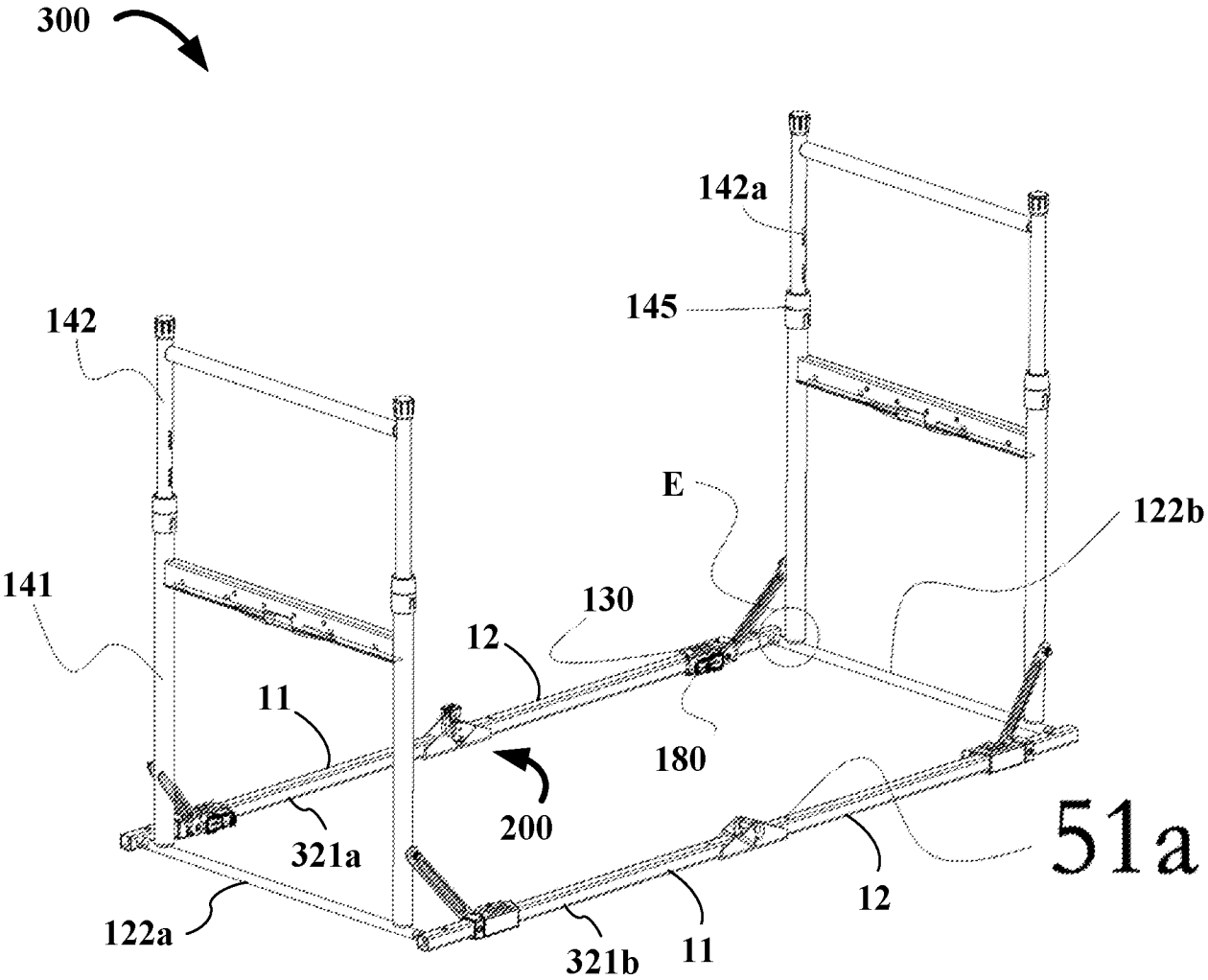
FIG. 17 is a bottom perspective view illustrating an exemplary frame in an unfolded state in accordance with exemplary embodiments of the present disclosure.
Figure 18:
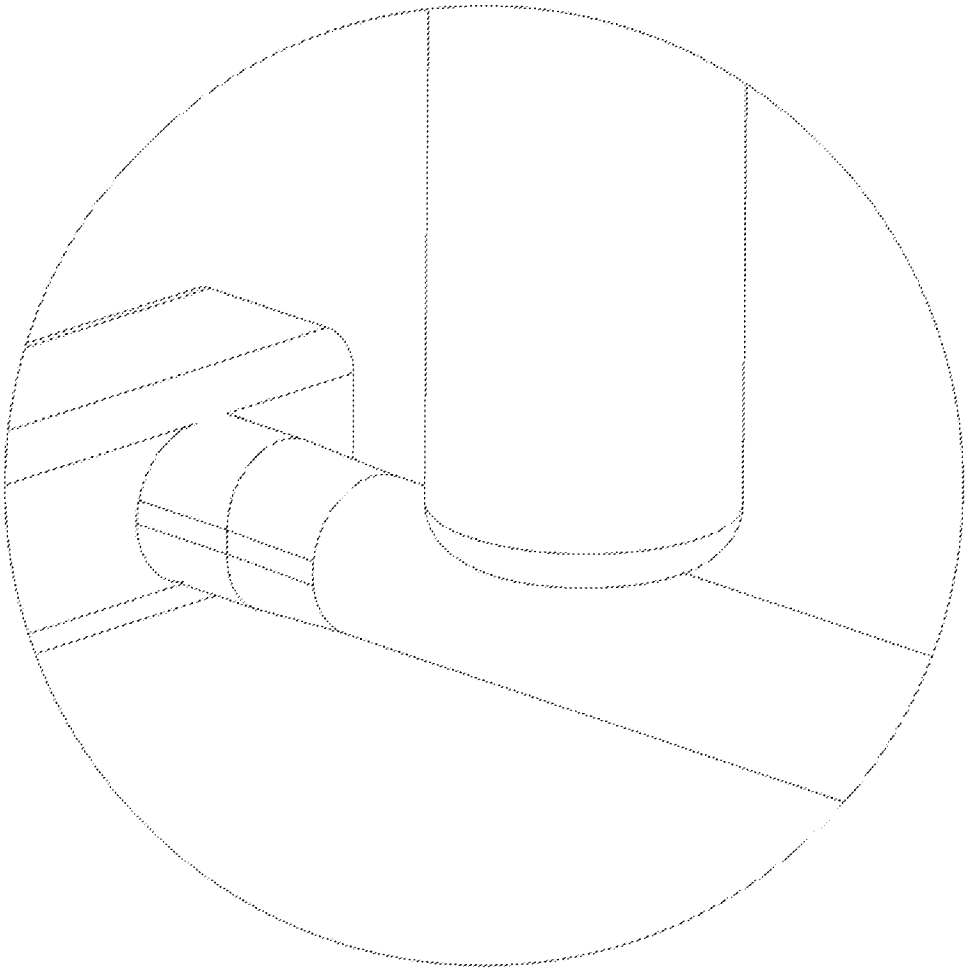
FIG. 18 is an enlarged view taken along circle E of FIG. 17.
Figure 19:
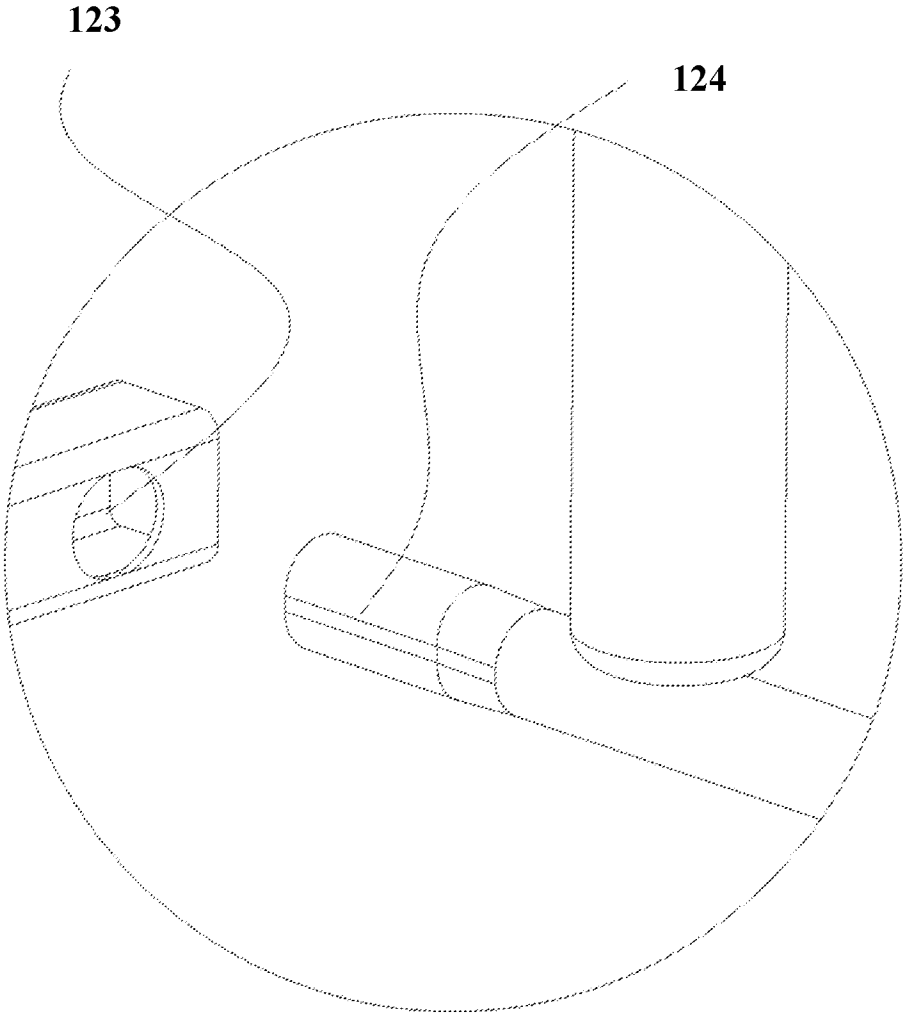
FIG. 19 is a disassembled view of FIG. 18.

In some exemplary embodiments, for at least one of first longitudinal bar 321*a* and second longitudinal bar 321*b*, first bar 11 and second bar 12 are pivotally connected with each other by a folding/unfolding mechanism such as folding/unfolding mechanism 200 disclosed herein. For instance, by way of example, FIG. 17 illustrates the first and second bars of first longitudinal bar 321*a* are pivotally connected with each other by folding/unfolding mechanism 200.

Similar to frame 120, frame 320 also includes a first lateral bar such as first lateral bar 122*a* disposed at a third side of the frame and a second lateral bar such as second lateral bar 122*b* disposed at a fourth side of the frame. Each of the first and second lateral bars has a first end pivotally connected with the first longitudinal bar and a second end pivotally connected with the second longitudinal bar. Frame 320 further includes a plurality of legs such as legs 140, each having an end fixedly connected with the first or second lateral bar. Leg 140 can be adjustable or non-adjustable, e.g., with or without locking/unlocking mechanism 145. In some exemplary embodiments, frame 320 further includes a plurality of oblique bars such as oblique bar 150 and a plurality of sliders such as slider 130. Each oblique bar 150 has one end pivotally connected with a corresponding leg and the other end pivotally connected with a corresponding slider that is slidably coupled with the first or second longitudinal bar.

In some exemplary embodiments, frame 120 or frame 320 includes additional, optional or alternative features. For instance, as illustrated in FIG. 17, each of first longitudinal bar 321*a* and second longitudinal bar 321*b* includes one or more holes or sinks such as hole or sink 51*a*. In an exemplary embodiment, the one or more holes or sinks are used to couple with a tabletop such as a tabletop disclosed herein (e.g., tabletop 110 or tabletop 310).

The frames and tables of the present disclosure have several advantages. For instance, the frames and tables can be folded in half by folding/unfolding mechanism 200, and thus are convenient for use and transportation. The legs can be folded or unfolded by the control of sliders 130, thereby further reducing the sizes of the frames and tables when folded. The height of the legs and consequently the height of the frames and tables can be adjusted using locking/unlocking mechanism 145, and thus can meet different needs of different users. Further, the configuration and coupling of hole 123 and engaging portion 124 enhance the stability of the frames and tables.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "top" or "bottom", "lower" or "upper", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first bar could be termed a second bar, and, similarly, a second bar could be termed a first bar, without changing the meaning of the description, so long as all occurrences of the "first bar" are renamed consistently and all occurrences of the "second bar" are renamed consistently.

What is claimed is:

1. A folding/unfolding mechanism comprising:

a first coupling piece configured to be fixed at a proximal end of a first bar, wherein the first coupling piece comprises a first hole and a first slot above the first hole, wherein the first slot has a closed bottom and an open top;

a second coupling piece configured to be fixed at a proximal end of a second bar, wherein the second coupling piece comprises a second hole and a second slot above the second hole, wherein the second slot has a closed bottom and an open top;

a third coupling piece comprising a third slot having a closed bottom and a closed top, wherein the third coupling piece is formed with an cavity;

an elastic member disposed in the cavity of the third coupling piece;

a cover coupled with the third coupling piece to encase the elastic member in the cavity of the third coupling piece;

a first rod passing through the first hole of the first coupling piece, the second hole of the second coupling piece, and the third slot of the third coupling piece, wherein the first and second coupling pieces are rotatable with respect to each other around the first rod, and the third coupling piece is movable with respect to the first rod between a first position where the first rod is at the bottom of the third slot of the third coupling piece and a second position where the first rod is at the top of the third slot of the third coupling piece; and a second rod integrally formed or coupled with a top portion of the third coupling piece, and movable together with the third coupling piece, wherein when the second rod is disposed in both of the first slot of the first coupling piece and the second slot of the second coupling piece, the first and second coupling pieces are restricted from rotating with respect to each other, and when the second rod is released from any one of the first slot of the first coupling piece and the second slot of the second coupling piece, the first and second coupling pieces are rotatable with respect to each other, wherein the elastic member has one end abutting the first rod and another end abutting the cover, thereby positioning the third coupling piece at the second position where the first rod is at the top of the third slot of the third coupling piece.

2. The folding/unfolding mechanism of claim 1, wherein the first slot of the first coupling piece comprises a first curved edge at the open top of the first slot to facilitate entry of the first rod into the first slot and exit of the first rod from the first slot, and the open top of the second slot of the second coupling piece comprises a second curved edge at the open top of the second slot to facilitate entry of the first rod into the second slot and exit of the first rod from the second slot.

3. The folding/unfolding mechanism of claim 1, wherein each of the first and second coupling pieces comprises a horizontal piece, a first lug at a first side of the horizontal piece and a second lug at a second side of the horizontal piece, wherein the first and second lugs are substantially parallel to each other; and each of the first and second lugs is formed with a corresponding first or second hole and a corresponding first or second slot.

4. The folding/unfolding mechanism of claim 3, wherein at least a portion of the third coupling piece is disposed between the first and second lugs of the first coupling piece, and at least a portion of the first and second lugs of the first coupling piece is disposed between the first and second lugs of the second coupling piece.

5. The folding/unfolding mechanism of claim 1, wherein the third coupling piece comprises a third hole, wherein the second rod is coupled with the third coupling piece by passing through the third hole of the third coupling piece.

6. The folding/unfolding mechanism of claim 1, wherein an external force is required to move the third coupling piece from the second position, where the first rod is at the top of the third slot of the third coupling piece, toward the first position, where the first rod is at the bottom of the third slot of the third coupling piece.

7. A frame comprising:

a first longitudinal bar disposed at a first side of the frame; and a second longitudinal bar disposed at a second side of the frame and substantially parallel to the first longitudinal bar;

wherein each of the first and second longitudinal bars comprises a first bar and a second bar pivotally connected with each other, and wherein for at least one of the first and second longitudinal bars, the first and second bars are pivotally connected with each other by a folding/unfolding mechanism comprising:

a first coupling piece fixed at a proximal end of the first bar, wherein the first coupling piece comprises a first hole and a first slot above the first hole, wherein the first slot has a closed bottom and an open top;

a second coupling piece fixed at a proximal end of the second bar, wherein the second coupling piece comprises a second hole and a second slot above the second hole, wherein the second slot has a closed bottom and an open top;

a third coupling piece comprising a third slot having a closed bottom and a closed top;

a first rod passing through the first hole of the first coupling piece, the second hole of the second coupling piece, and the third slot of the third coupling piece, wherein the first and second coupling pieces are rotatable with respect to each other around the first rod, and the third coupling piece is movable with respect to the first rod between a first position where the first rod is at the bottom of the third slot of the third coupling piece and a second position where the first rod is at the top of the third slot of the third coupling piece;

an elastic member disposed in an interior of the third coupling piece between the first rod and a bottom cover of the third coupling piece; and a second rod integrally formed or coupled with a top portion of the third coupling piece, and movable together with the third coupling piece, wherein when the second rod is disposed in both of the first slot of the first coupling piece and the second slot of the second coupling piece, the first and second coupling pieces are restricted from rotating with respect to each other, when the second rod is released from any one of the first slot of the first coupling piece and the second slot of the second coupling piece, the first and second coupling pieces are rotatable with respect to each other, and the elastic member exerts a force on the first rod and the bottom cover of the third coupling piece, thereby positioning the third coupling piece at the second position where the first rod is at the top of the third slot of the third coupling piece.

8. The frame of claim 7, wherein each of the first and second coupling pieces comprises a horizontal piece, a first lug at a first side of the horizontal piece and a second lug at a second side of the horizontal piece, wherein the first and second lugs are substantially parallel to each other; and each of the first and second lugs is formed with a corresponding first or second hole and a corresponding first or second slot.

9. The frame of claim 7, wherein the third coupling piece comprises a third hole, wherein the second rod is coupled with the third coupling piece by passing through the third hole of the third coupling piece.

10. The frame of claim 7, further comprising:

a first lateral bar disposed at a third side of the frame and having a first end pivotally connected with the first longitudinal bar and a second end pivotally connected with the second longitudinal bar;

a second lateral bar disposed at a fourth side of the frame and having a first end pivotally connected with the first longitudinal bar and a second end pivotally connected with the second longitudinal bar;

a plurality of legs, each having an end fixedly connected with the first or second lateral bar;

a plurality of oblique bars, each having a first end and a second end, wherein the first end of each respective oblique bar in the plurality of oblique bars is pivotally connected with a corresponding leg in the plurality of legs; and a plurality of sliders, each slidably coupled with the first or second longitudinal bar and pivotally coupled with the second end of an oblique bar in the plurality of oblique bars.

11. The frame of claim 7, wherein each of the first and second longitudinal bars is formed with an oval or oblong hole at a distal end thereof, the frame further comprising:

a first lateral bar disposed at a third side of the frame and having a first end pivotally connected with the first longitudinal bar and a second end pivotally connected with the second longitudinal bar; and a second lateral bar disposed at a fourth side of the frame and having a first end pivotally connected with the first longitudinal bar and a second end pivotally connected with the second longitudinal bar, wherein each of the first and second lateral bars comprises an end portion of an oval or oblong cross-section at each of the first and second sides of the frame to couple with the oval or oblong hole.

12. The frame of claim 7, wherein each leg in the plurality of legs comprises an upper leg and a lower leg telescopically connected with each other.

13. The frame of claim 12, wherein each respective leg in the plurality of legs further comprises a locking/unlocking mechanism fixedly coupled with the upper leg, wherein the lower leg comprises a plurality of holes along the longitudinal direction of the lower leg, and the locking/unlocking mechanism comprises a protrusion configured to be insertable into any one of the plurality of holes of the lower leg, thereby facilitating adjustment of a height of the respective leg.

14. A table comprising:

the frame of claim 7; and a tabletop coupled with the frame and supported by the frame when in use.

15. The table of claim 14, wherein the tabletop comprises a first panel coupled with the first bars of the first and second longitudinal bars and a second panel coupled with the second bars of the first and second longitudinal bars to facilitate folding of the table in half.

16. A frame comprising:

a first longitudinal bar disposed at a first side of the frame;

a second longitudinal bar disposed at a second side of the frame and substantially parallel to the first longitudinal bar;

a first lateral bar disposed at a third side of the frame and having a first end pivotally connected with the first longitudinal bar and a second end pivotally connected with the second longitudinal bar;

a second lateral bar disposed at a fourth side of the frame and having a first end pivotally connected with the first longitudinal bar and a second end pivotally connected with the second longitudinal bar;

a plurality of legs, each having an end fixedly connected with the first or second lateral bar;

a plurality of oblique bars, each having a first end and a second end, wherein the first end of each respective oblique bar in the plurality of oblique bars is pivotally connected with a corresponding leg in the plurality of legs; and a plurality of sliders, each slidably coupled with the first or second longitudinal bar and pivotally coupled with the second end of an oblique bar in the plurality of oblique bars wherein each of the first and second longitudinal bars comprises a first bar and a second bar pivotally connected with each other, and wherein for at least one of the first and second longitudinal bars, the first and second bars are pivotally connected with each other by a folding/unfolding mechanism comprising:

a first coupling piece fixed at a proximal end of the first bar, wherein the first coupling piece comprises a first hole and a first slot above the first hole, wherein the first slot has a closed bottom and an open top;

a second coupling piece fixed at a proximal end of the second bar, wherein the second coupling piece comprises a second hole and a second slot above the second hole, wherein the second slot has a closed bottom and an open top;

a third coupling piece comprising a third slot having a closed bottom and a closed top;

a first rod passing through the first hole of the first coupling piece, the second hole of the second coupling piece, and the third slot of the third coupling piece, wherein the first and second coupling pieces are rotatable with respect to each other around the first rod, and the third coupling piece is movable with respect to the first rod between a first position where the first rod is at the bottom of the third slot of the third coupling piece and a second position where the first rod is at the top of the third slot of the third coupling piece; and a second rod integrally formed or coupled with a top portion of the third coupling piece, and movable together with the third coupling piece, wherein when the second rod is disposed in both of the first slot of the first coupling piece and the second slot of the second coupling piece, the first and second coupling pieces are restricted from rotating with respect to each other, and when the second rod is released from any one of the first slot of the first coupling piece and the second slot of the second coupling piece, the first and second coupling pieces are rotatable with respect to each other, wherein each slider comprises:

a sleeve slidably coupled with the first or second longitudinal bar, wherein a first hole and a pillar are formed at a first side wall of the sleeve;

a pivoting portion integrally formed or coupled with the first side wall of the sleeve, and pivotally coupled with the second end of an oblique bar in the plurality of oblique bars; and a controller disposed side by side with the pivoting portion along a longitudinal direction of the sleeve, and configured to control movement of the sleeve along the first or second longitudinal bar, wherein the controller comprises:

a casing integrally formed or coupled with the first side wall of the sleeve and surrounding the first hole and the pillar formed at the first side wall of the sleeve;

a lever comprising a first end portion aligned with the first hole formed at the first side wall of the sleeve, a second end portion aligned with the pillar formed at the first side wall of the sleeve, and a middle portion between the first and second portions and pivotally connected with the casing;

a pin integrally formed or coupled with the first end portion of the level, wherein the pin has a free end toward the first hole formed at the first side wall of the sleeve; and an elastic member engaged with the pillar formed at the first side wall of the sleeve, the elastic member having a first end abutting the first side wall of the sleeve and a second end abutting the second portion of the lever, wherein when the first hole formed at the first side wall of the sleeve aligns with a hole of the first or second longitudinal bar, the elastic member pushes the free end of the pin into the first hole formed at the first side wall of the sleeve and the hole of the first or second longitudinal bar, thereby restricting movement of the sleeve with respect to the first or second longitudinal bar.

17. The frame of claim 16, further comprising:

a plurality of stoppers, each fixedly coupled with a longitudinal bar in the first the second longitudinal bars at a position between a lateral bar in the first and second lateral bars and a corresponding slider in the plurality of sliders, thereby preventing the corresponding slider from moving further toward the lateral bar and thus preventing the plurality of legs from rotating beyond its unfolded state.

18. The frame of claim 17, wherein:

each respective stopper in the plurality of stoppers comprises a protrusion; and a second side wall of the sleeve of the corresponding slider is formed with a notch at an end portion of the sleeve to receive the protrusion of the respective stopper.

* * * * *